US006793586B2

(12) United States Patent
Barlow et al.

(10) Patent No.: US 6,793,586 B2
(45) **Date of Patent: *Sep. 21, 2004**

(54) GOLF PUTTING AND CHIPPING PRACTICE GREEN

(75) Inventors: David R. Barlow, 7620 Harborview Way N., Seminole, FL (US) 33776; John Hutzenlaub, Oakpark, IL (US)

(73) Assignee: David R. Barlow, Seminole, FL (US)

( * ) Notice: Subject to any disclaimer, the term of this patent is extended or adjusted under 35 U.S.C. 154(b) by 5 days.

This patent is subject to a terminal disclaimer.

(21) Appl. No.: 10/349,461

(22) Filed: Jan. 22, 2003

(65) Prior Publication Data

US 2003/0190969 A1 Oct. 9, 2003

Related U.S. Application Data

(63) Continuation-in-part of application No. 10/115,168, filed on Apr. 3, 2002, now Pat. No. 6,669,572.

(51) Int. Cl.[7] ..... A63B 69/36
(52) U.S. Cl. ..... 473/162; 473/60
(58) Field of Search ..... 473/157–164

(56) References Cited

U.S. PATENT DOCUMENTS 1,914,365 A 6/1933 Ford
2,515,847 A 7/1950 Winkler
3,661,687 A 5/1972 Spinney, Jr. et al.
3,669,454 A 6/1972 Kolonel
3,715,123 A 2/1973 Baum
3,727,918 A 4/1973 Zawacki
3,735,988 A 5/1973 Palmer et al.
3,743,295 A 7/1973 Flowers
3,871,650 A 3/1975 Casey
4,202,547 A 5/1980 Mueller
4,211,417 A 7/1980 Brown
4,244,576 A 1/1981 Mosier et al.
5,007,644 A 4/1991 Bluthardt et al.
5,042,813 A 8/1991 Huang
5,366,224 A 11/1994 Stanwyck et al.
5,916,034 A 6/1999 Lancia
6,302,803 B1 10/2001 Barlow
6,338,682 B1 1/2002 Torchia et al.
6,413,166 B1 7/2002 Long

*Primary Examiner*—Mark S. Graham
(74) *Attorney, Agent, or Firm*—Larson & Larson, PA; James E. Larson

(57) ABSTRACT

Multiple molded polymeric panels of various configurations are mechanically fastened together along a side surface having alternating upright and downward facing steps containing fastening elements to provide putting greens of different dimensions and shape. Each panel has a planar top surface and a bottom integral grid supporting structure. A simulated grass overlies the joined panels. Raised pads are optionally placed between the top surface of the panels and the simulated grass to provide a contoured green.

20 Claims, 33 Drawing Sheets

GOLF PUTTING AND CHIPPING PRACTICE GREEN

PRIOR APPLICATIONS

This application is a continuation-in-part from application Ser. No. 10/115,168, filed on Apr. 3, 2002, now U.S. Pat. No. 6,669,572.

FIELD OF THE INVENTION

This invention relates to practice golf putting and chipping greens. More particularly, it refers to a multi-sectional polymeric putting and chipping green wherein sectional polymeric panels are held together by tongue and groove or other mechanical locking features.

BACKGROUND OF THE INVENTION

The expanding interest in golf has created a demand for golf practice tools, particularly putting and chipping greens. The ability to put and chip accurately distinguishes the ordinary golfer from the skilled golfer. With an interest in improving golf putting skills, the portable golf putting green of U.S. Pat. No. 6,302,803 was developed. Although the portable golf putting green described in this patent has been commercially accepted and serves its intended purpose, a need exists for variations that suit particular markets. In particular, a need exists for an inexpensive indoor/outdoor putting and chipping green.

SUMMARY OF THE INVENTION

The invention of this application is a multiplicity of one piece sectional polymeric panels attachable by locking features to adjacent panels in various directions to create a synthetic indoor/outdoor green. The fastened together panels are covered by a simulated grass layer to create a putting surface simulating a putting green or a green to which one can chip. The multiple polymeric panels are prepared by compression, blow, injection or other molding process to prepare a smooth, planar top surface integral with a bottom grid structure. Locking features are mounted at an end of each panel juxtaposed to an adjacent polymeric panel.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1A:
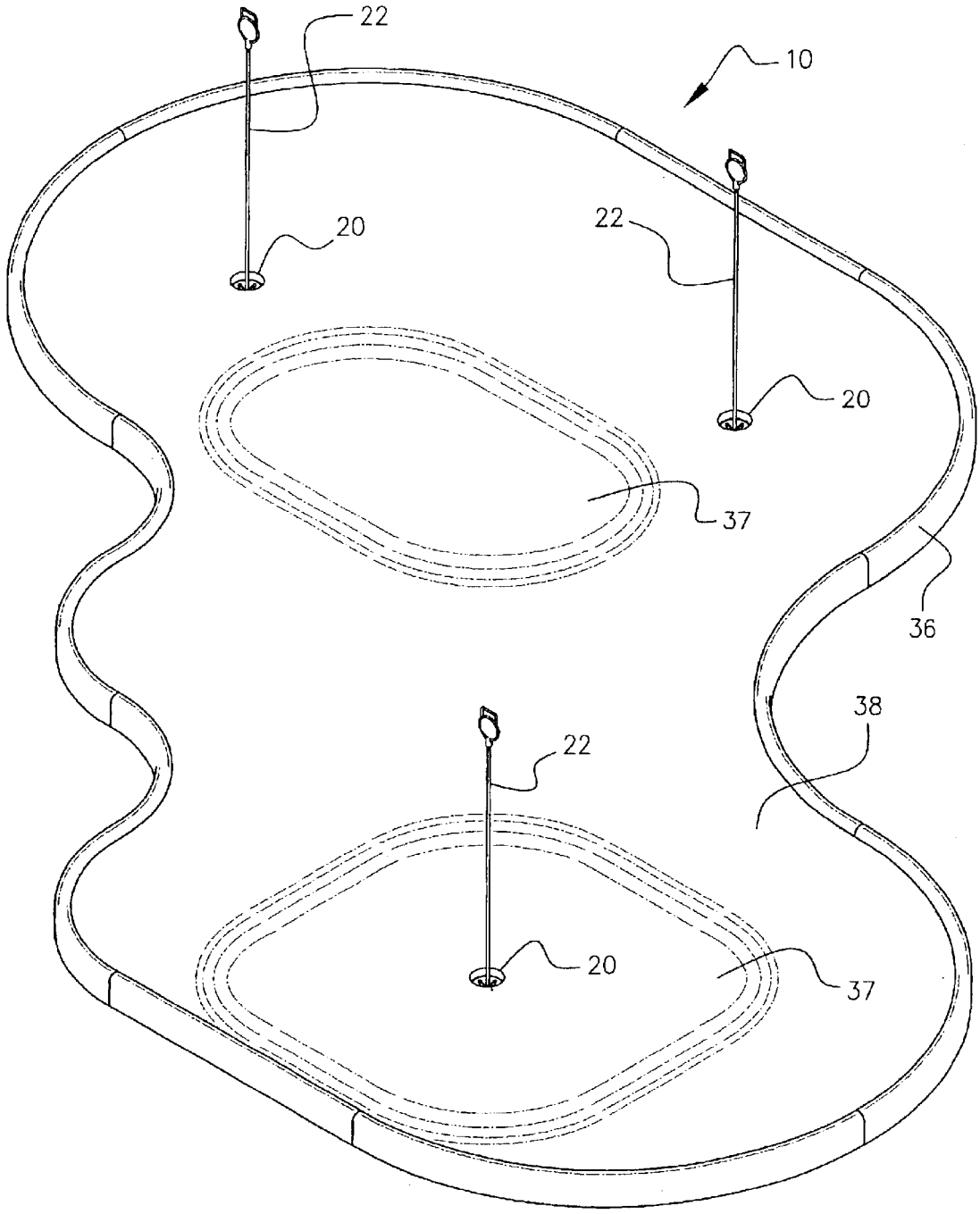
FIG. 1A is a perspective view of a putting green layout of this invention showing edge contours.

Throughout the following detailed description, the same reference numerals refer to the same elements in all figures.

Figure 1B:
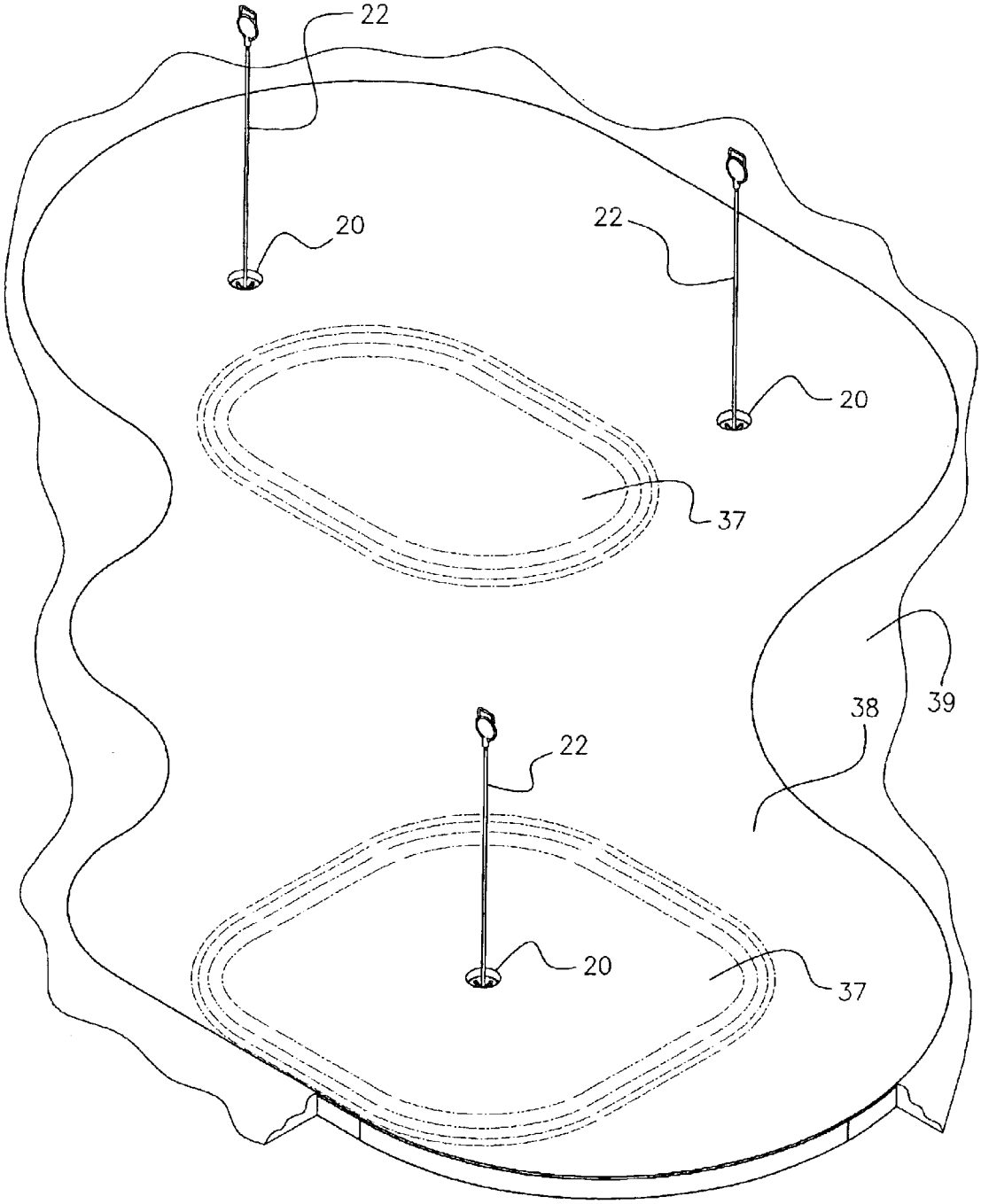
FIG. 1B is a perspective view of a putting green layout of this invention showing the putting surface feathered into adjacent soil.
Figure 2:
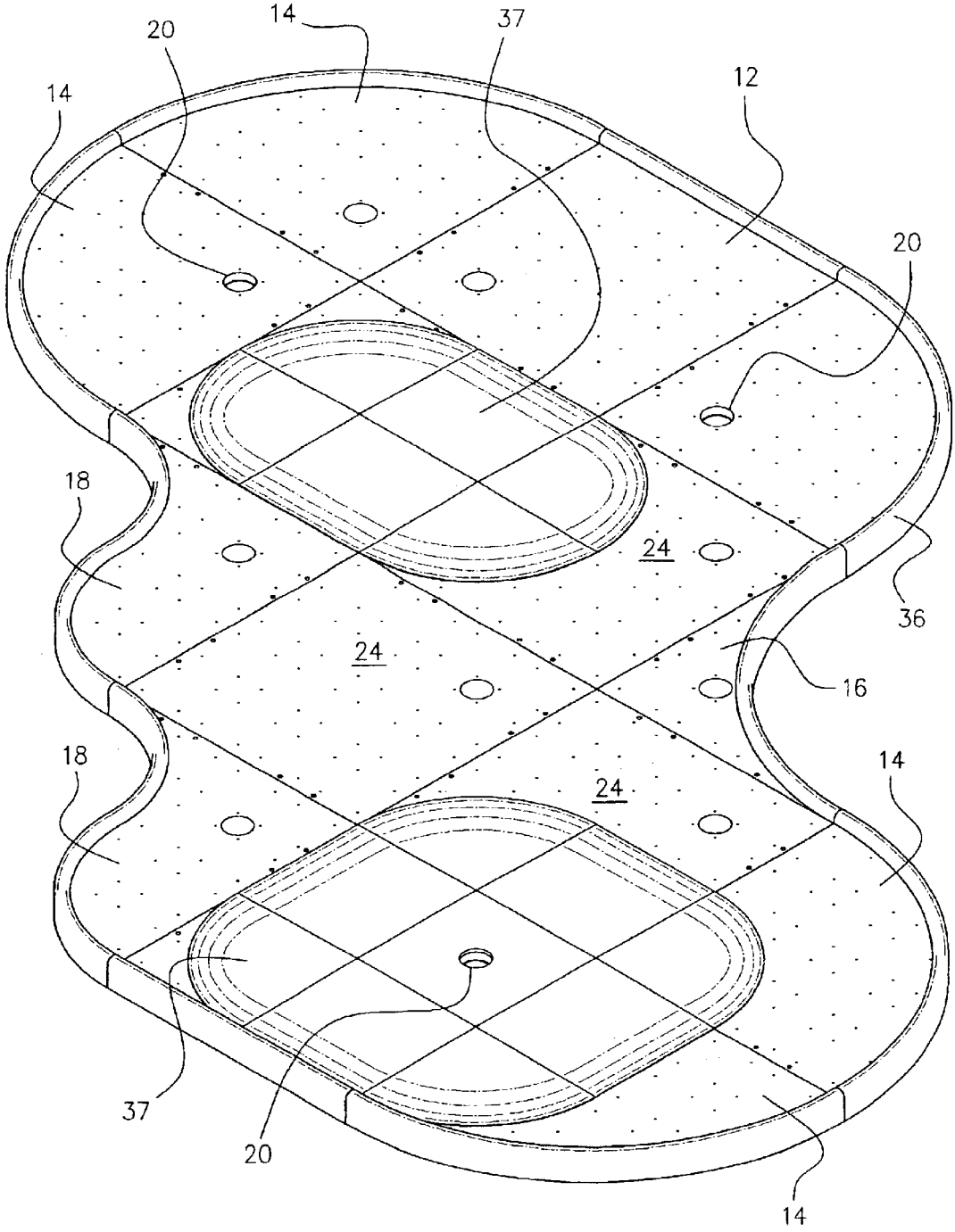
FIG. 2 is a perspective view of multiple polymeric panels of different shapes fastened together to form the layout shown in FIG. 1A.

Referring first to FIGS. 1A, 1B and 2, the practice green 10 is a curved unit having multiple panels mechanically locked together. Each panel 12, 14, 16, 18 and 24 is a polymeric unit having a first planar top surface portion 25 and an integral grid bottom portion 40. Each panel has a cup 20 for receipt of putted golf balls and a ball remover stand 22 or a plug 27.

Figure 3:
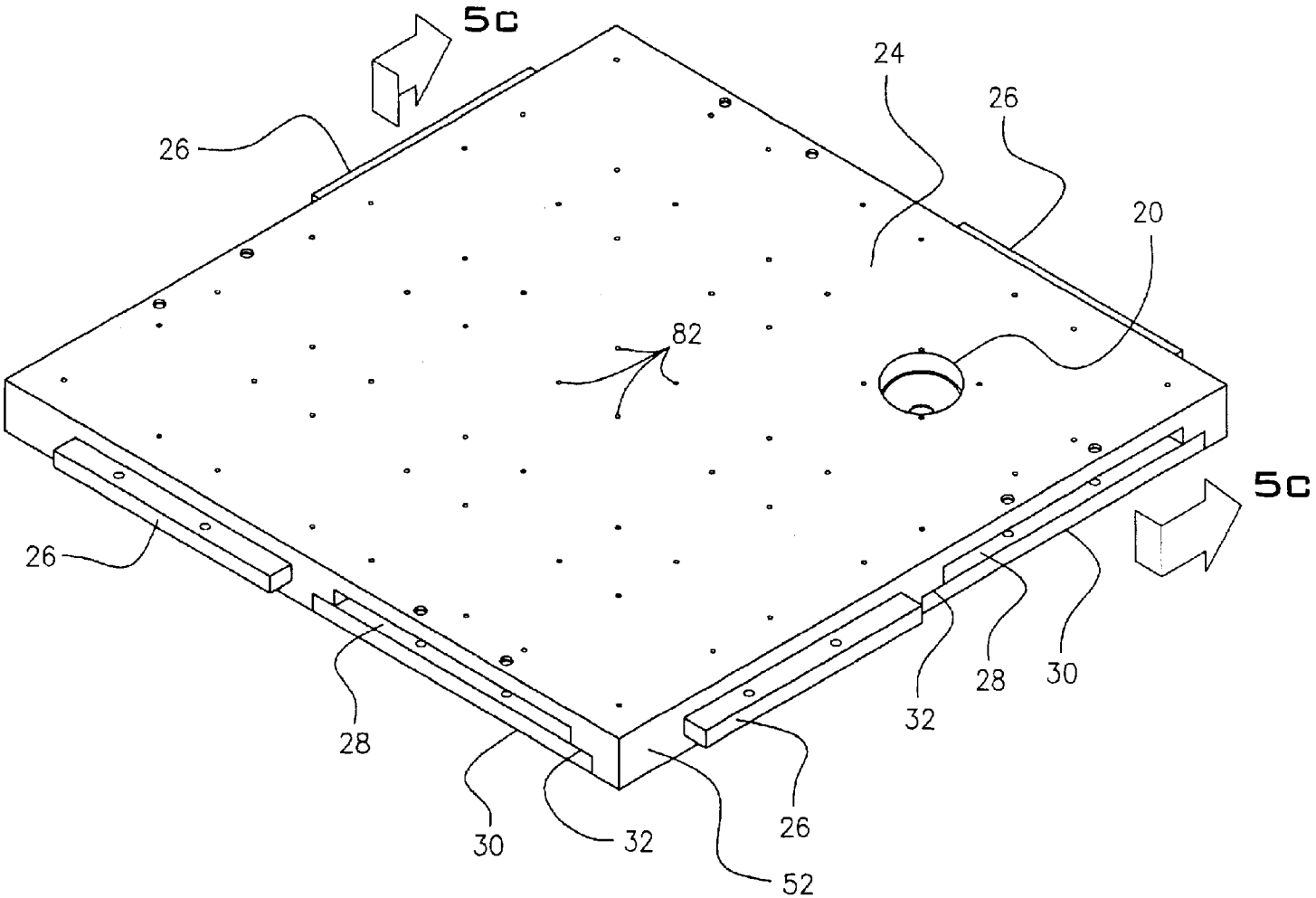
FIG. 3 is a perspective view of one shape of an interior polymeric panel used in the layout of FIG. 2.
Figure 4:
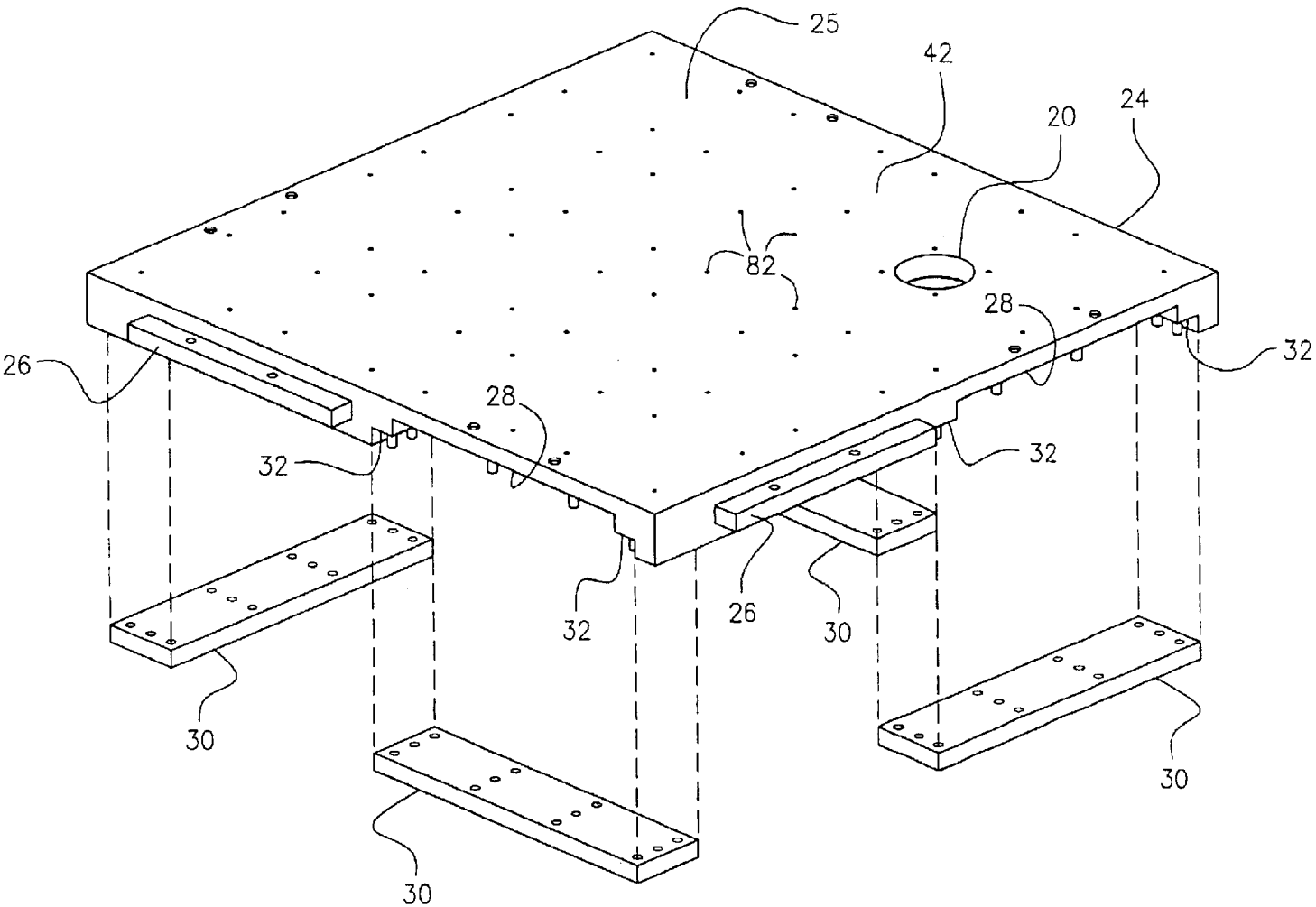
FIG. 4 is a top exploded view of the polymeric panel of FIG. 3 showing its component parts.

The inside panel 24, as well as panels 12, 14, 16, and 18 have a tongue and groove locking mechanism as seen in FIG. 3. Each panel has tongues 26 on each side 52 opposite an adjacent panel. A slot 28 is formed by attaching a filler plate 30 to a flange 32 on a bottom surface 34 of the panel. See FIGS. 4, 5A and 5B.

Figure 5A:
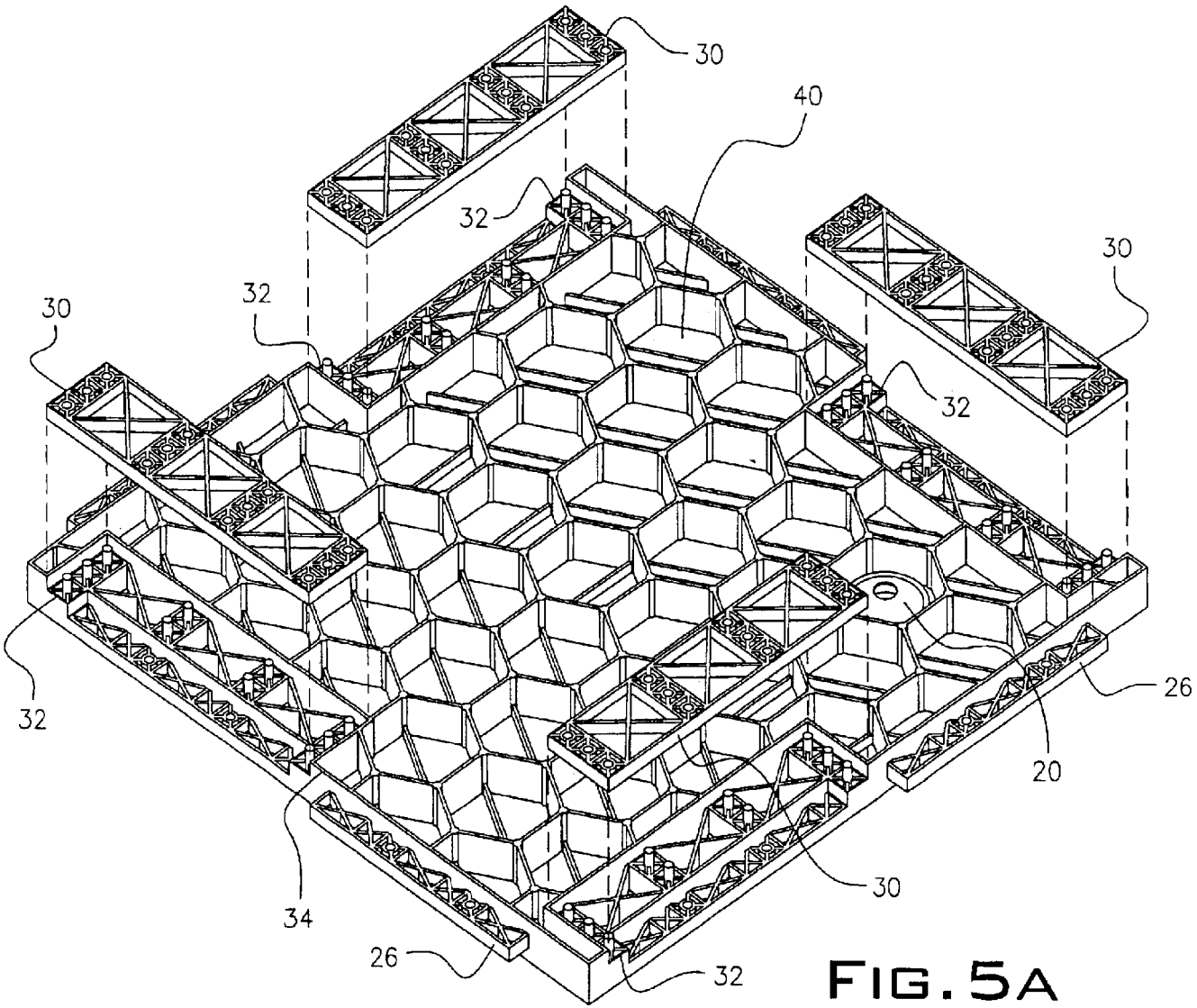
FIG. 5A is a bottom exploded view of the polymeric panel of FIG. 3 showing its component parts.
Figure 5B:
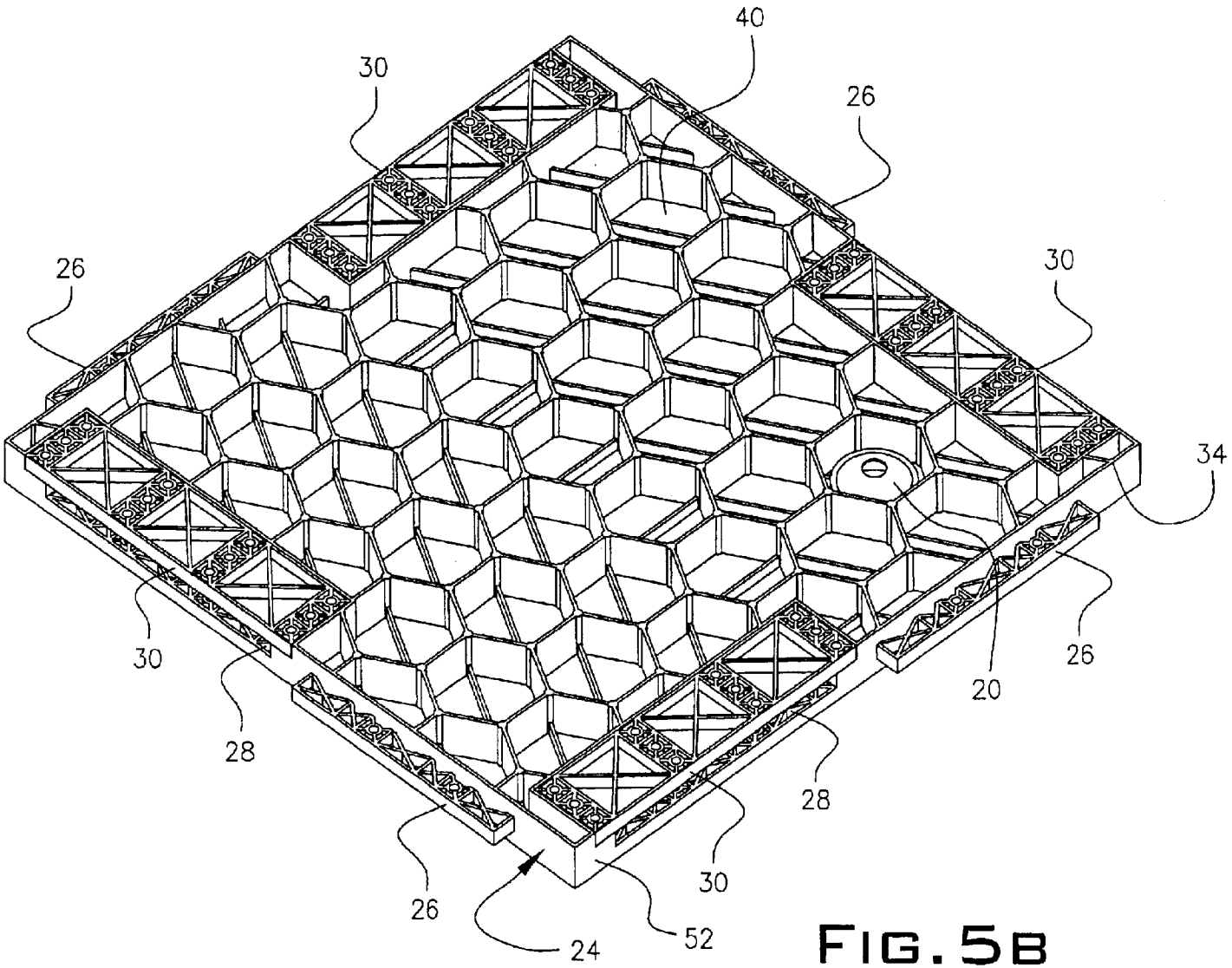
FIG. 5B is a bottom view of the polymeric panel of FIG. 3.
Figure 5C:
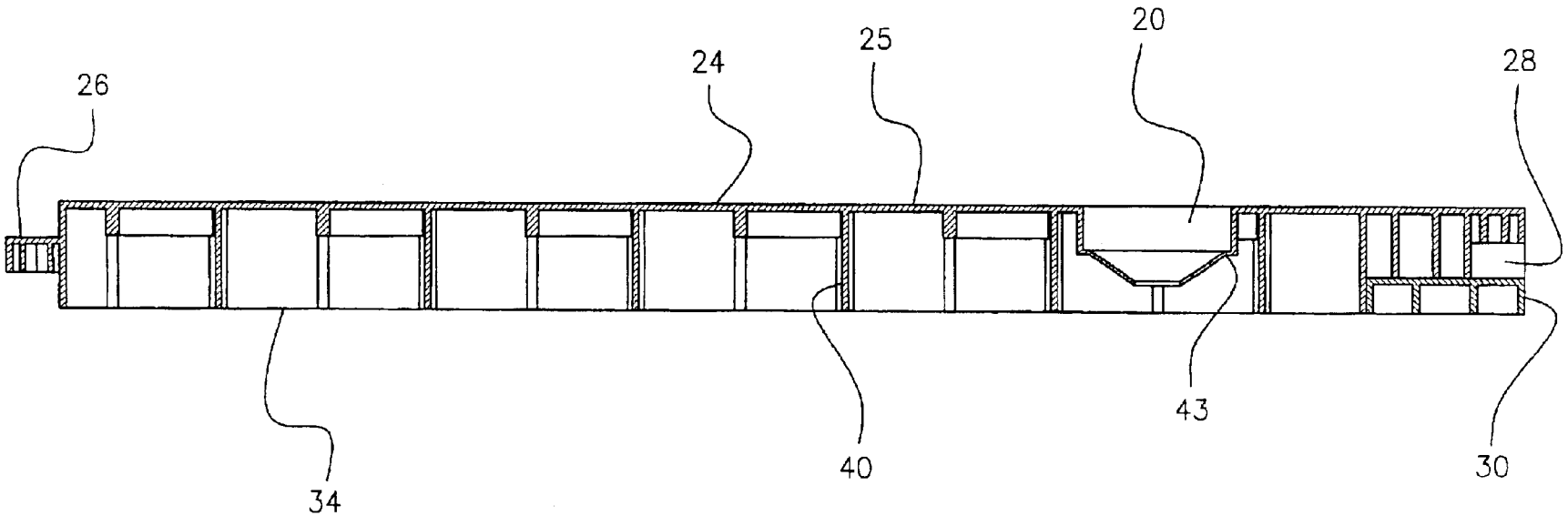
FIG. 5C is a side sectional elevation along line 5C—5C in FIG. 3.
Figure 5D:
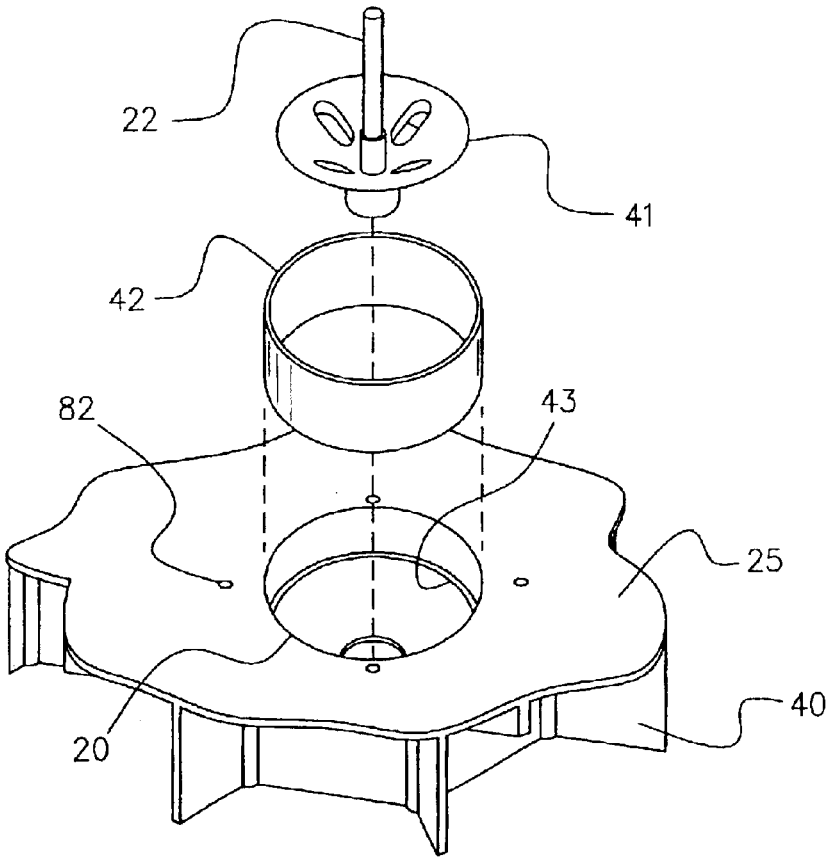
FIG. 5D is an exploded view of the cup configuration components in a polymeric panel.
Figure 5E:
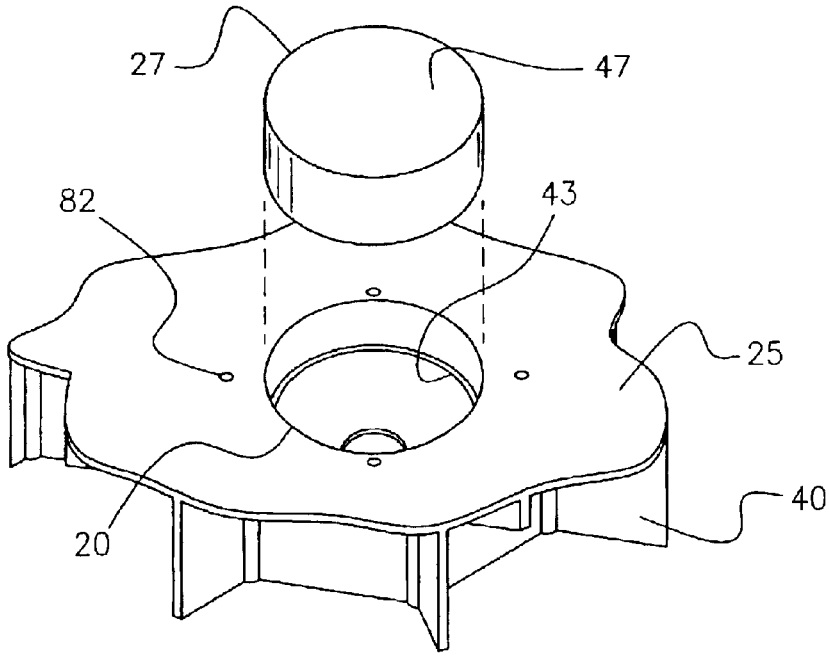
FIG. 5E is an exploded view of a plug and cup.
Figure 6:
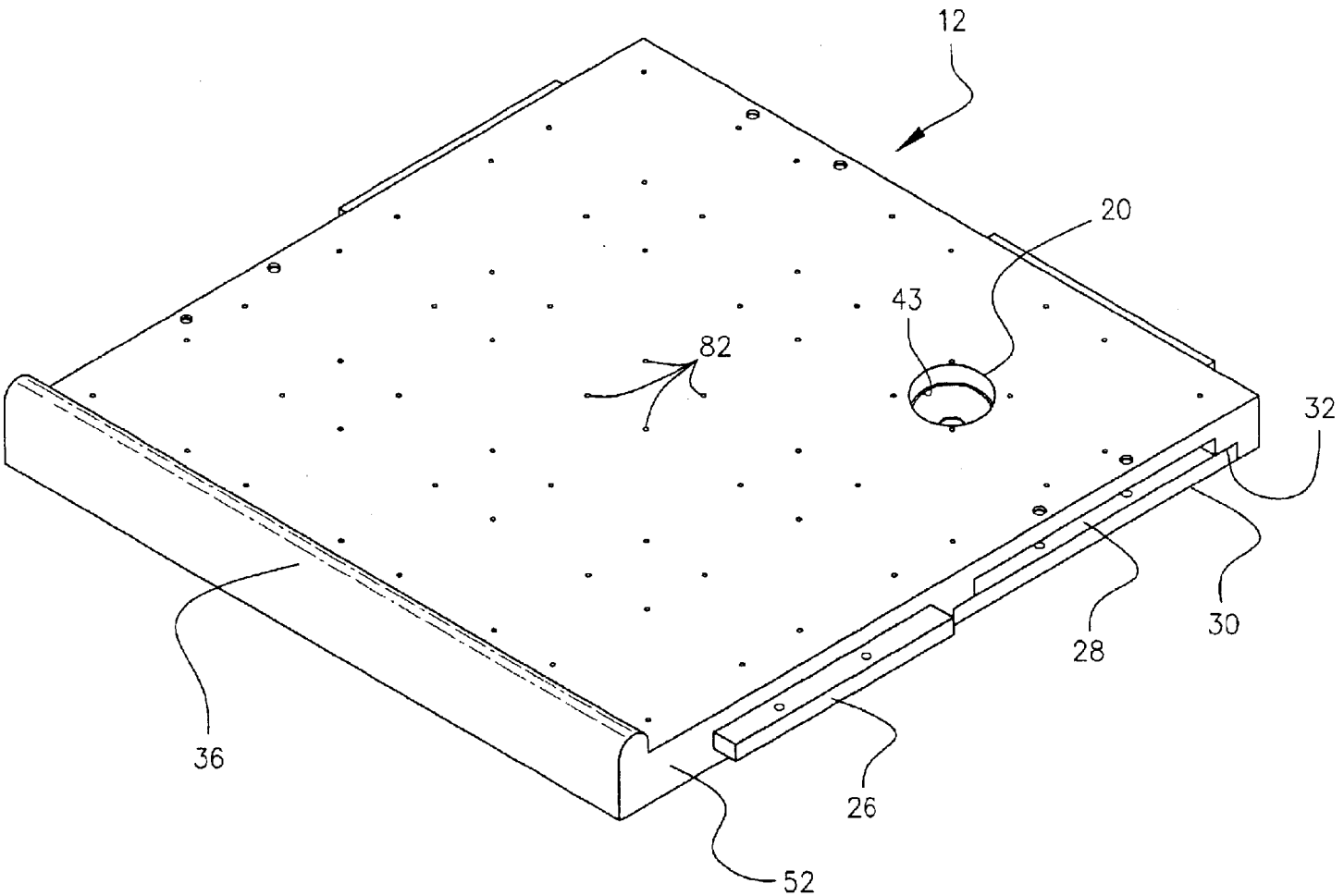
FIG. 6 is a perspective view of a first polymeric edge panel from FIG. 2.
Figure 7:
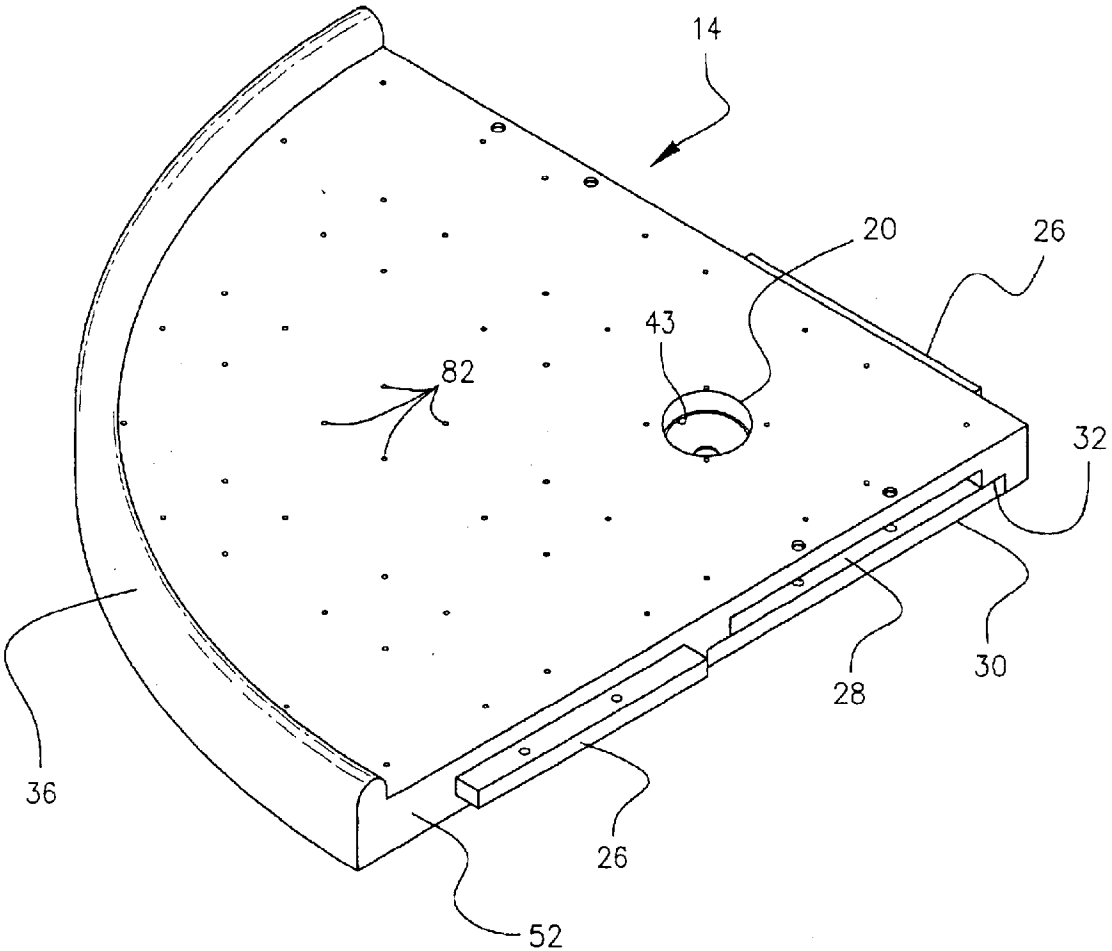
FIG. 7 is a perspective view of a second polymeric edge panel from FIG. 2.
Figure 8:
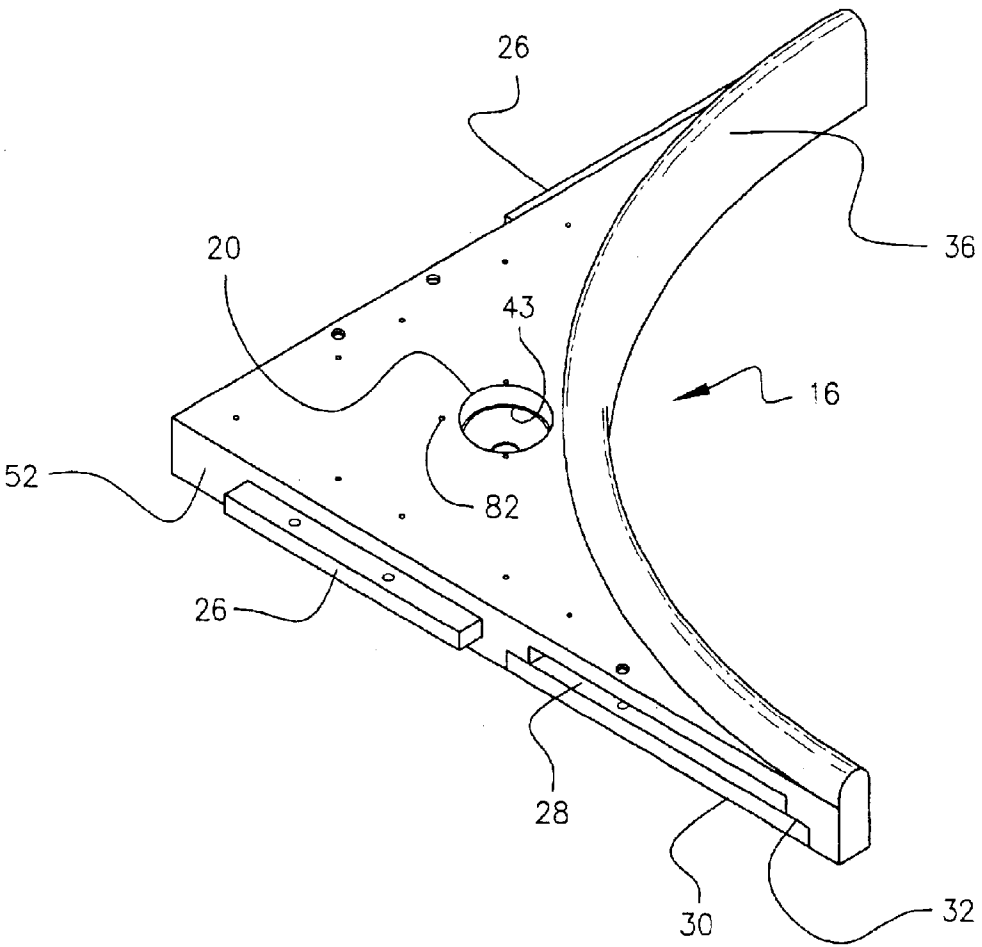
FIG. 8 is a perspective view of a third polymeric edge panel from FIG. 2.
Figure 9:
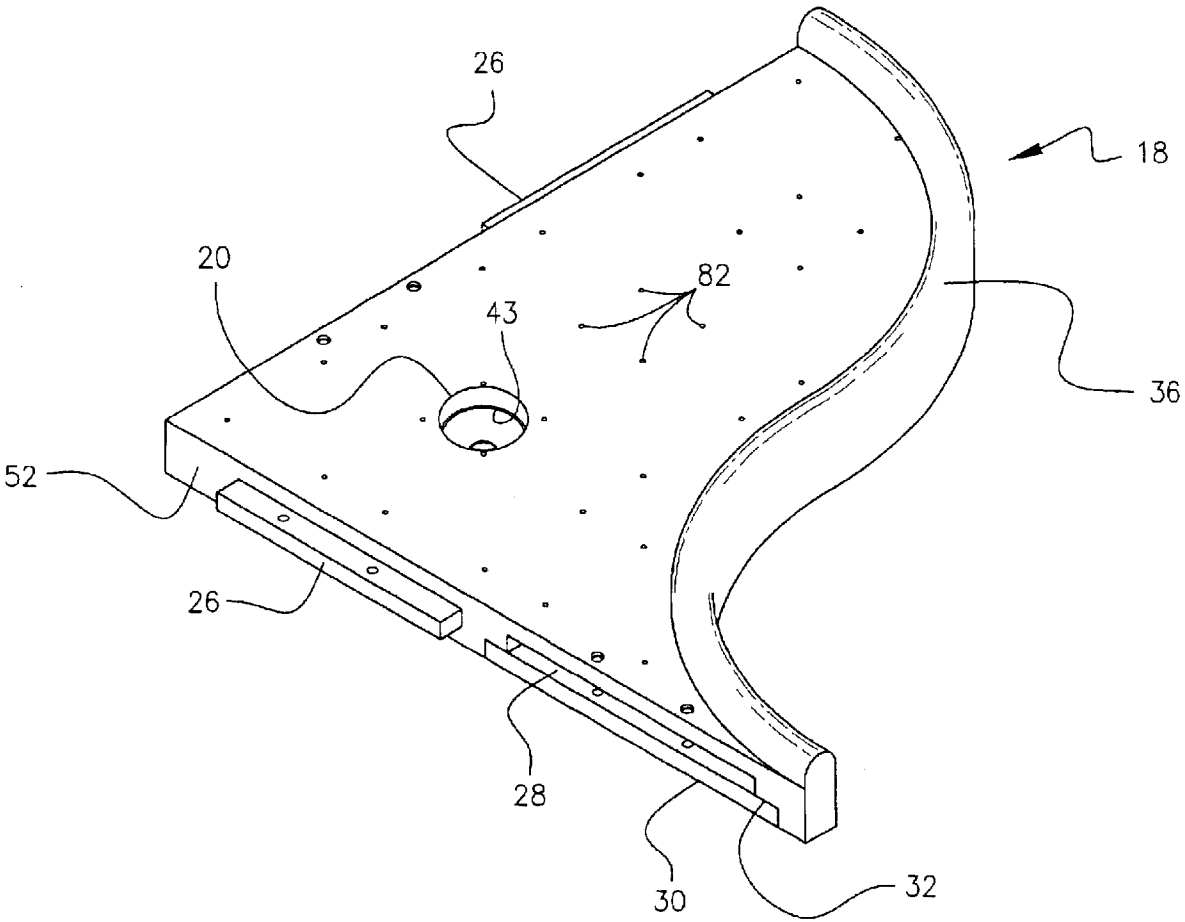
FIG. 9 is a perspective view of a fourth polymeric edge panel from FIG. 2.

Each panel has a cup 20 as seen in FIGS. 5C–E. A collar 42 sits on a flange 43 inside the cup 20. The bottom portion 41 of flag stick 22 sits in the cup 20 inside of collar 42. If a cup is not needed for a particular panel, then a plug 27 is inserted on flange 43 so that the top surface 47 of the plug 27 is contiguous with planar surface 25 of the panel.

Any of the side panels can have an optional raised edge or bump rail 36 molded into the panel as seen in FIGS. 6–9. Alternatively, if the putting green 10 is set on a sand bed outside over soil 39 as seen in FIG. 1B, it can be feathered in at its non-raised edges with the adjacent grass so that the practice green can be used to direct chips towards the flags 22.

The putting green 10 can take various shapes depending on the number of panels employed and the configuration of the panels employed. The square panels 12 or 24 are approximately 34 inches square. The 34 inch square panels have about a 2.25 inch deck height and larger 44 inch square panels have about a 3.0 inch deck height. By using these panels a complete series of eighteen holes can be configured with different outside shapes.

As seen in FIG. 1A, the simulated grass 38 fits into the bottom edge of the bump rail 36 to give a clean putting surface. Alternatively, as seen in FIG. 1B, the simulated grass 38 outer edge is covered with soil 39. A series of contiguous raised pads 37 can be placed intermediate surface 25 on the panel and the simulated grass 38.

The grid structure 40 integral with the flat top 25 of panel 24 supports the panel as seen in FIGS. 5A and 5B.

Figure 10:
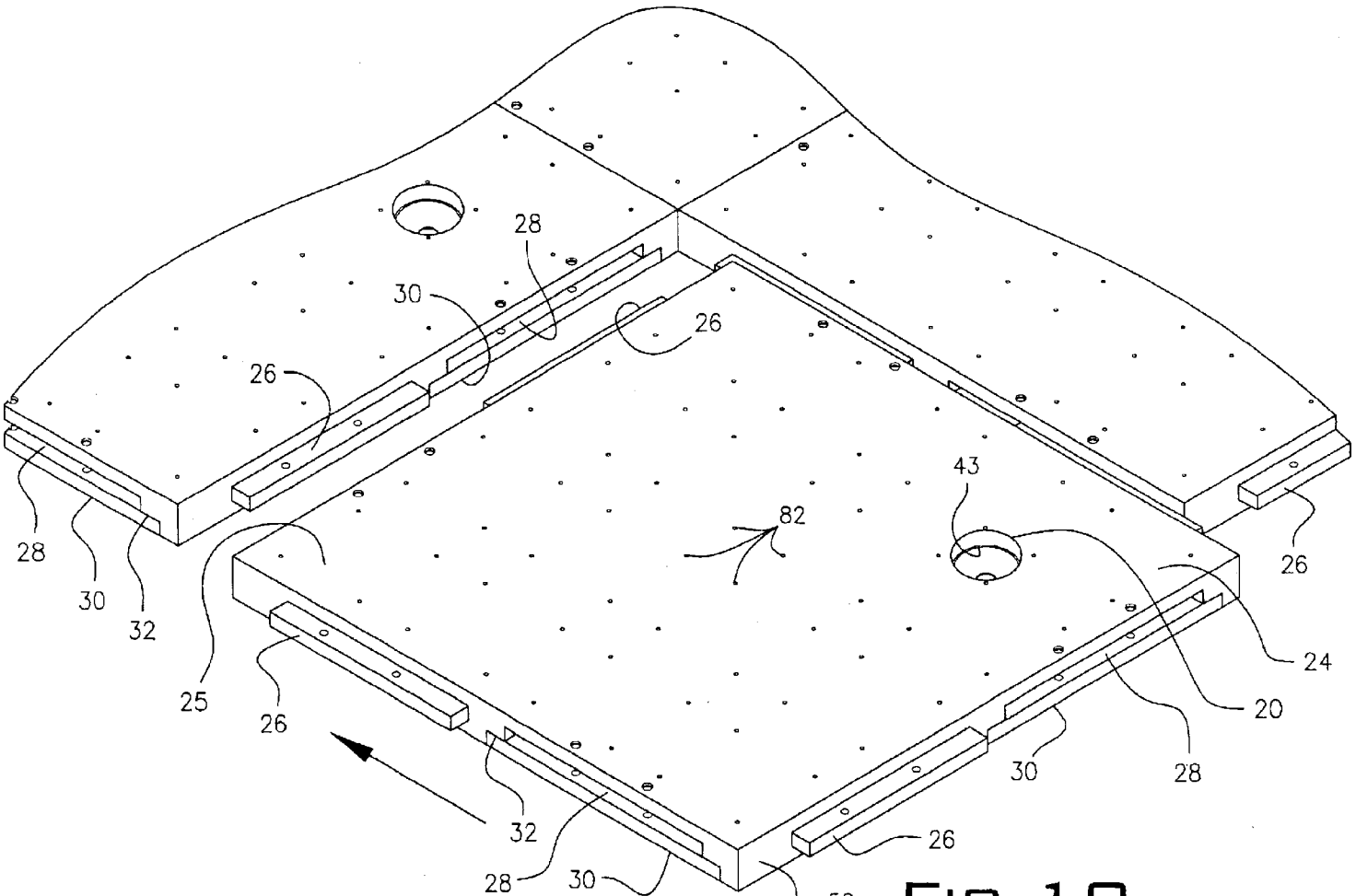
FIG. 10 is a perspective view of a first step of locking polymeric panels together with a tongue and groove mechanical locking system.
Figure 11:
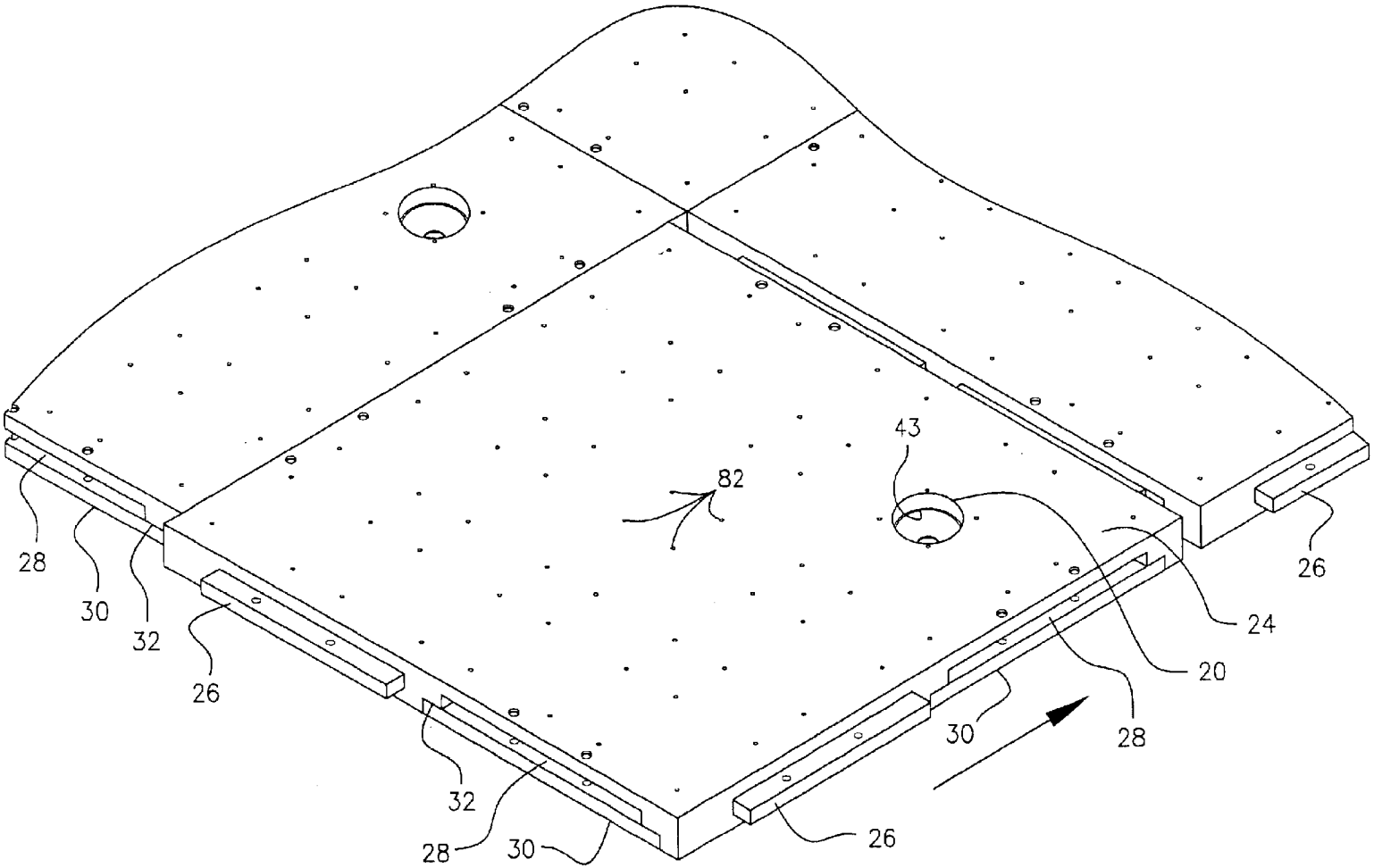
FIG. 11 is a perspective view of the panels according to FIG. 10 showing a further locking step.
Figure 12:
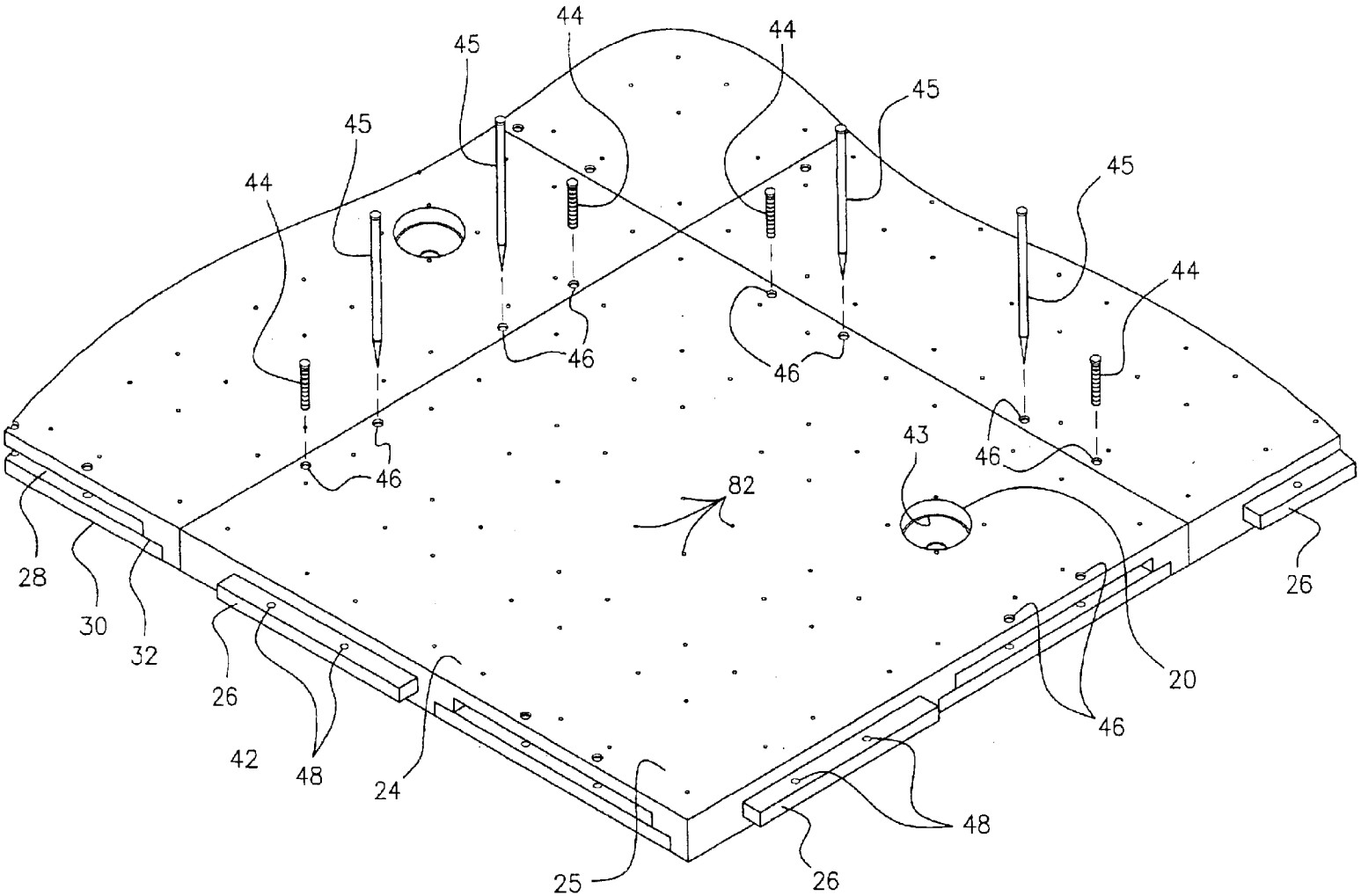
FIG. 12 is a perspective view of the panels according to FIG. 10 showing four panels locked together.

As seen in FIGS. 10 and 11, the panels with the tongue 26 and groove 28 configuration are attached to adjacent panels by first sliding the panel 24 in the direction shown by the arrow in FIG. 10 and thereafter in the direction shown by the arrow in FIG. 11. As shown in FIG. 12, screws 44 can be threaded through bores 46 in top surface 42 and through complimentary bores 48 in tongue 26 to prevent the panels from disengaging. Pegs 45 can be driven through holes 46 into the turf or sand below the panel.

Figure 13:
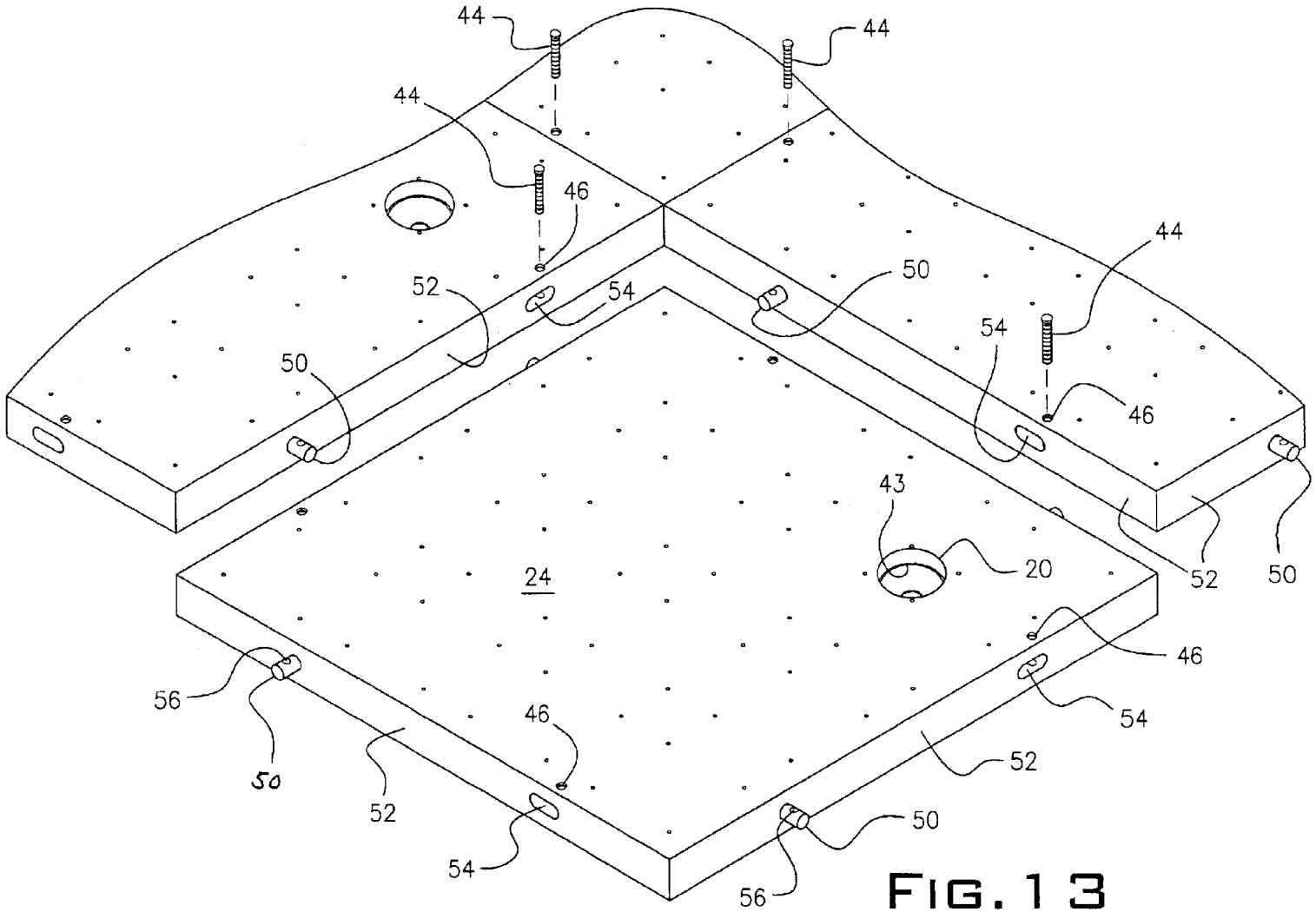
FIG. 13 is a perspective view of multiple polymeric panels being locked together employing a first alternate mechanical locking mechanism.

A first alternate locking mechanism is seen in FIG. 13 wherein rods 50 project from a side surface 52 of panel 24. A dowel 50 is inserted into a side slot 54 in an adjacent panel and a peg 44 is inserted through bore 46 on a top surface of the panel and through a bore 56 in rod 50 to lock the panels together and prevent disengagement.

Figure 14:
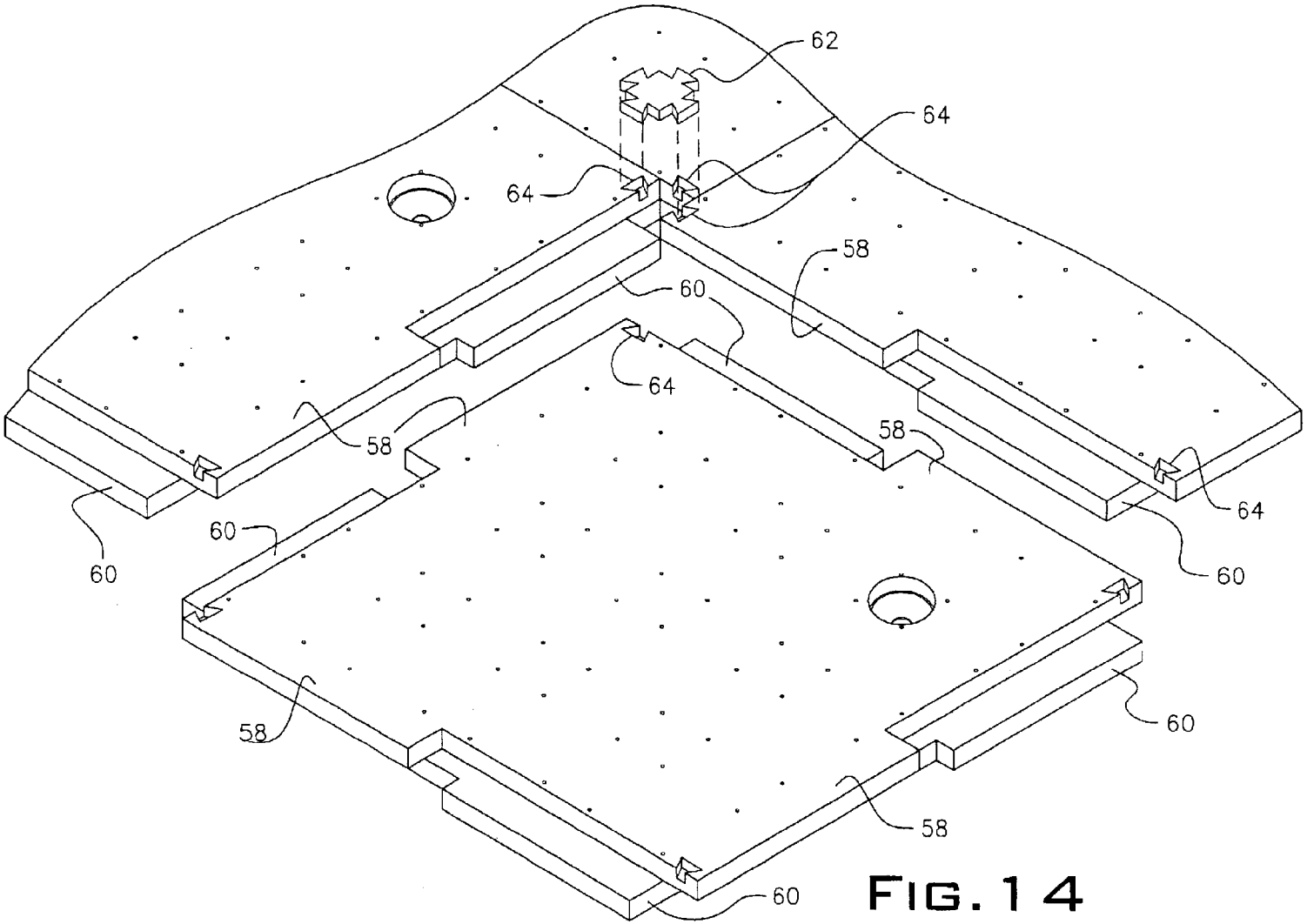
FIG. 14 is a perspective view of multiple polymeric panels locked together employing a second alternate mechanical locking mechanism.

A second alternate locking mechanism is seen in FIG. 14 wherein each panel has a top lip 58 and a bottom lip 60 that interlock with a complementary bottom and top lip, respectively. The panels are held together by a star tongue 62 that fits into triangular slots 64 at the meeting point of four panel corners.

Figure 15:
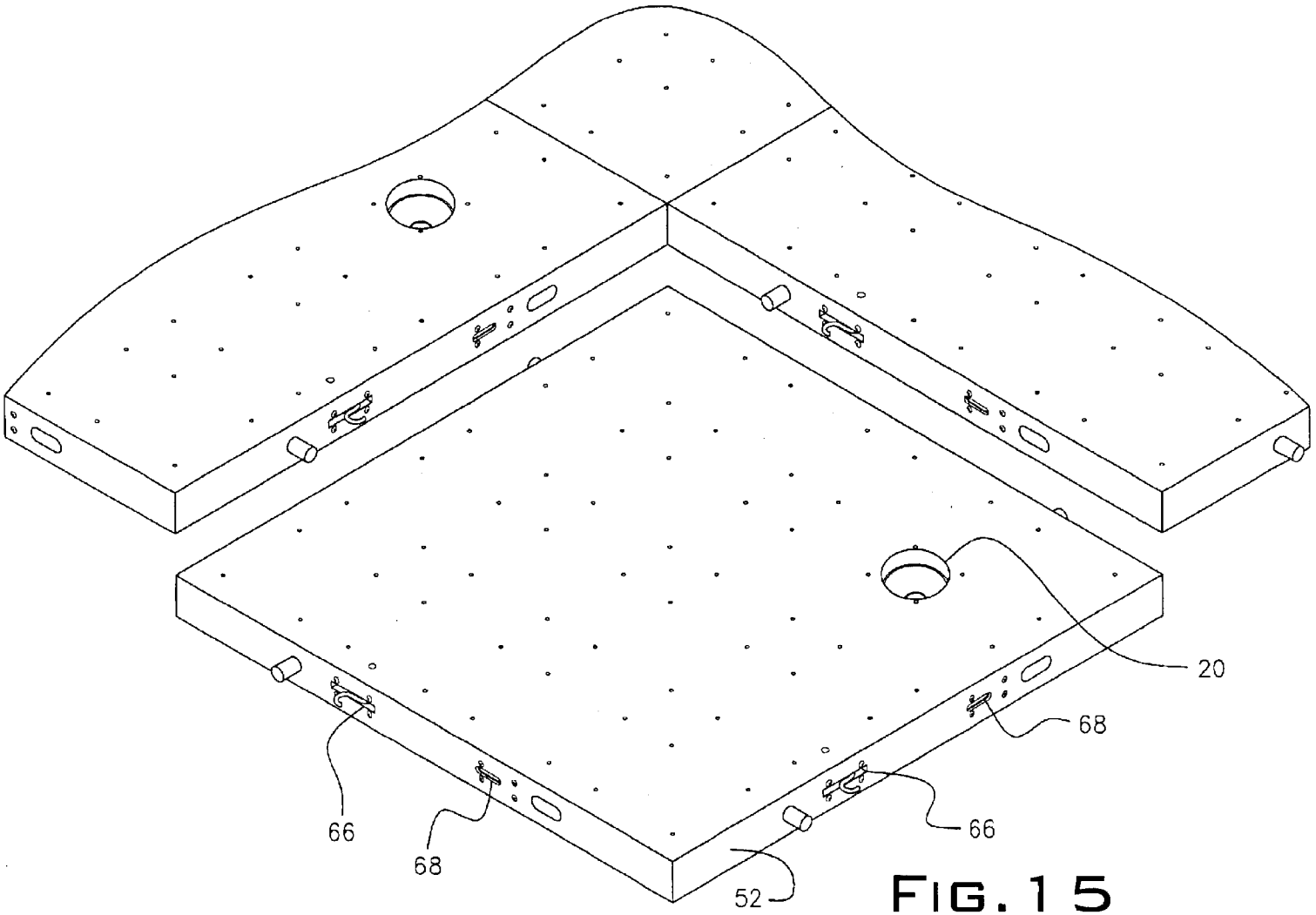
FIG. 15 is a perspective view of multiple polymeric panels locking together employing a third alternate mechanical locking mechanism.

FIG. 15 shows a third alternate locking mechanism. A cammed S-hook 66 is mounted in a side slot 68 of a polymeric panel side 52. By turning an allen wrench, after sides 52 are brought together, the S-hook engages a back edge in opposite slot 68. Each side 52 has one S-hook and one slot 68.

Figure 16:
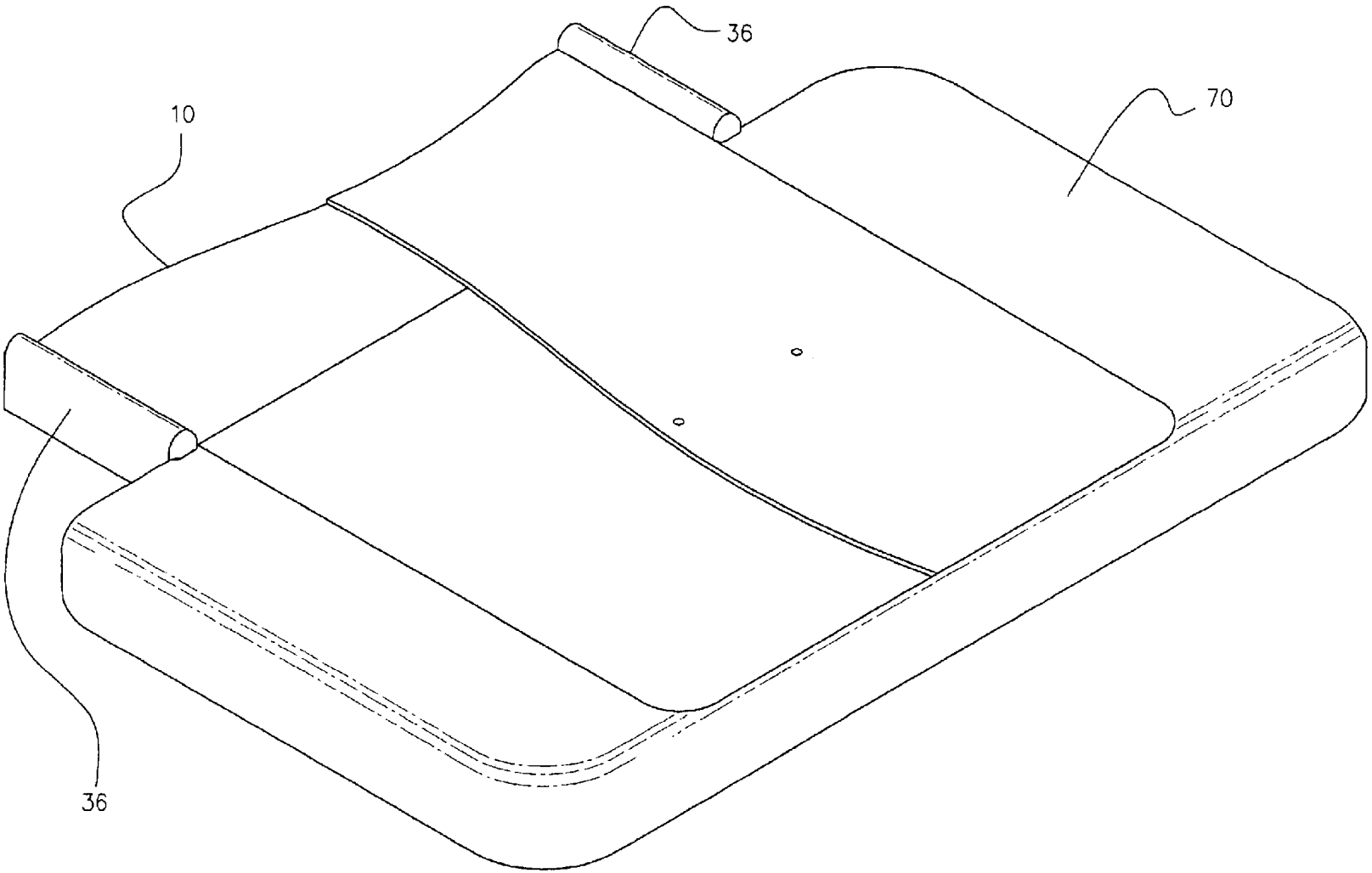
FIG. 16 is a perspective view of a putting practice stand.
Figure 17:
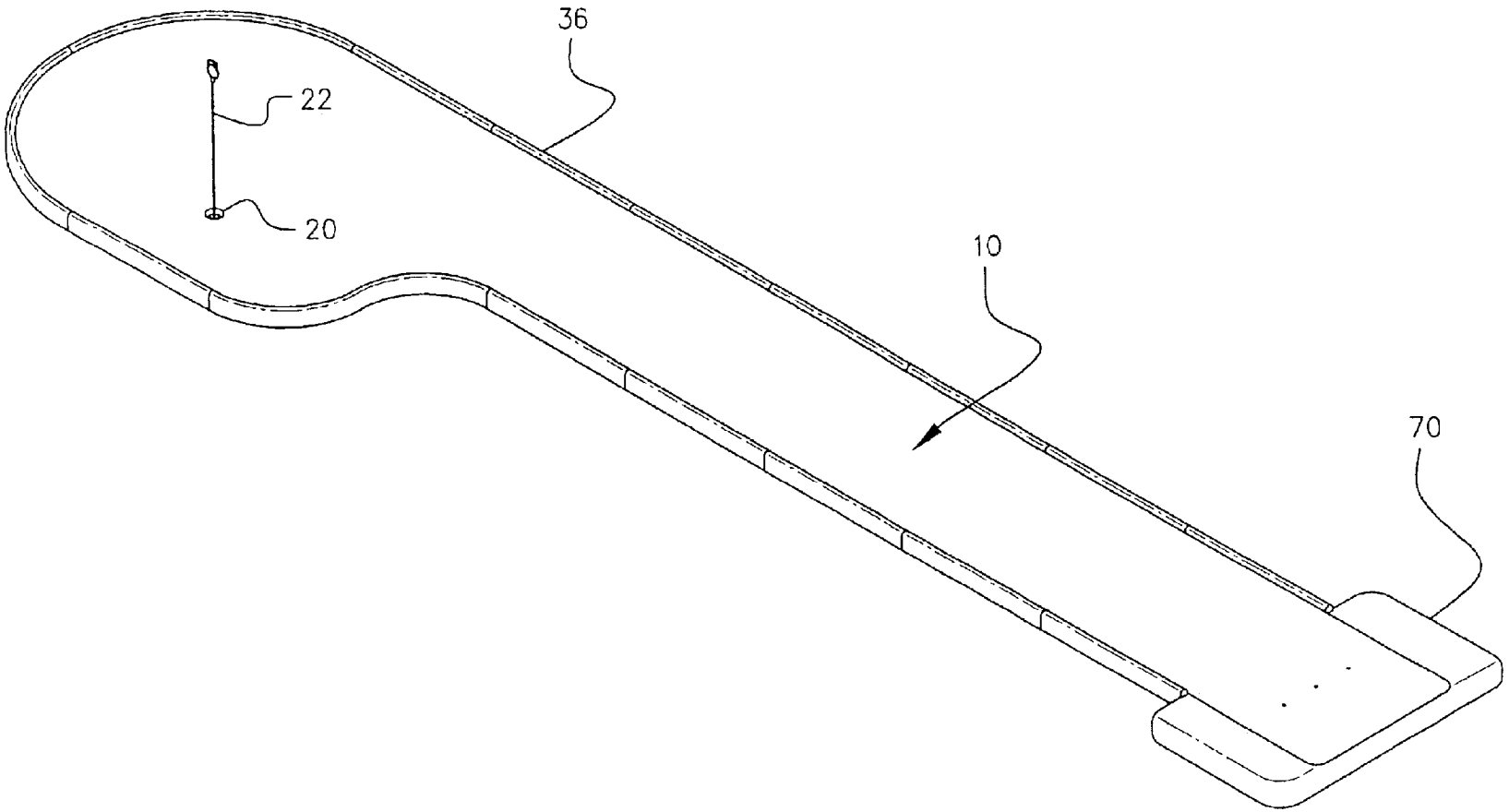
FIG. 17 is a perspective view of an alternate putting green layout according to this invention.
Figure 18:
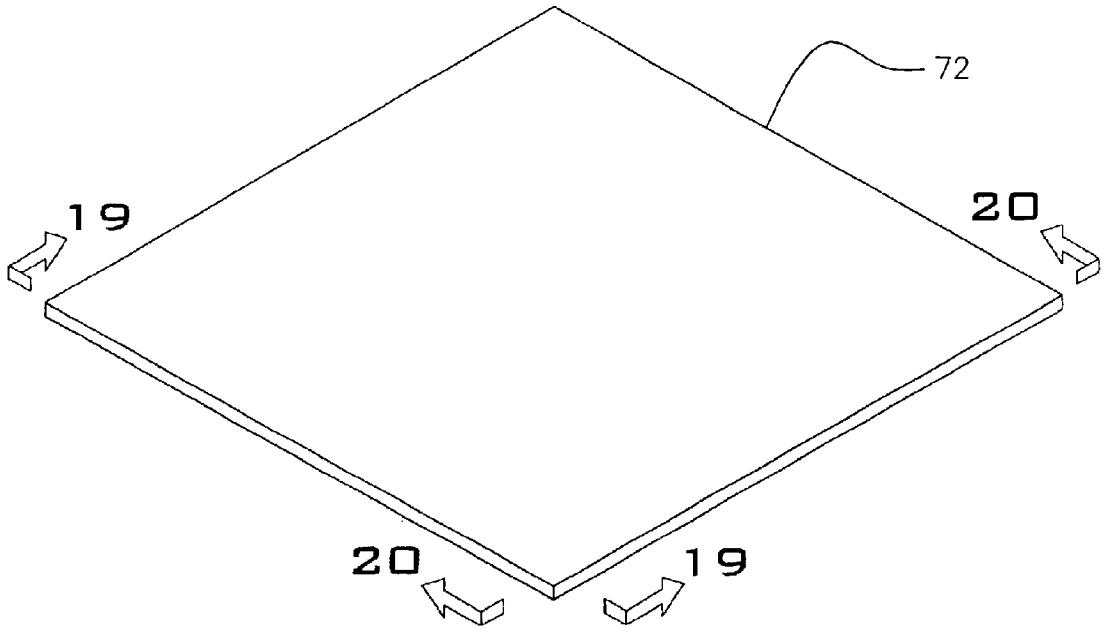
FIG. 18 is a top perspective view of a first auxiliary thin panel to adjust the slant of the putting surface.
Figure 19:
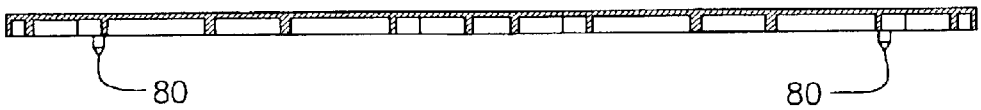
FIG. 19 is a sectional view in elevation of the thin panel of FIG. 18 along line 19—19.
Figure 20:
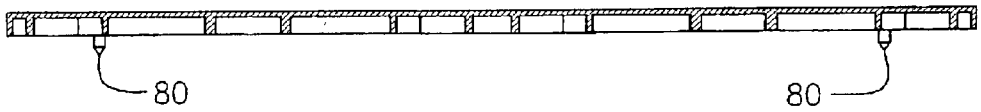
FIG. 20 is a sectional view in elevation of the thin panel of FIG. 18 along line 20—20.
Figure 21:
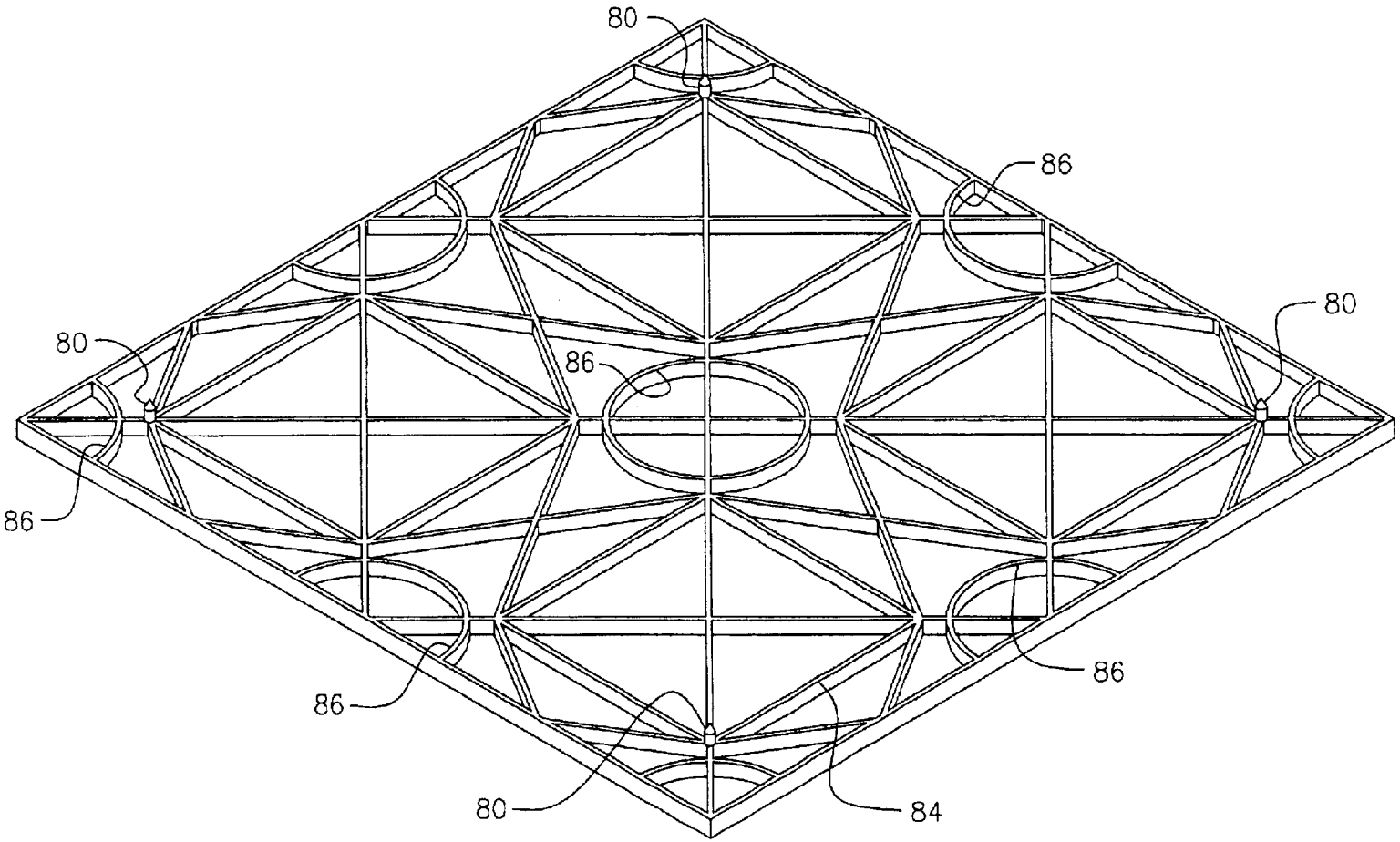
FIG. 21 is a bottom perspective view of the thin panel of FIG. 18.
Figure 22:
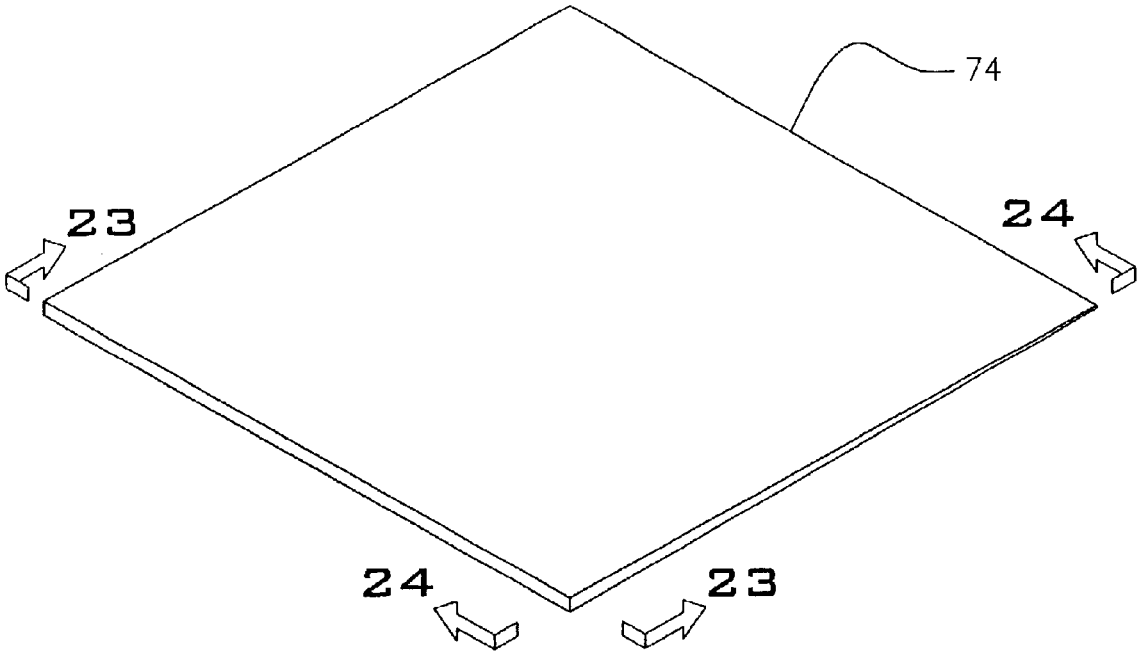
FIG. 22 is a top perspective view of a second auxiliary thin panel to adjust the slant of the putting surface.
Figure 23:
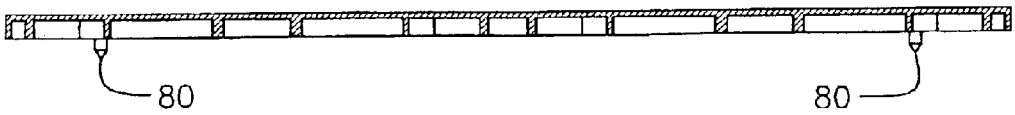
FIG. 23 is a sectional view in elevation of the thin panel of FIG. 22 along line 23—23.
Figure 24:
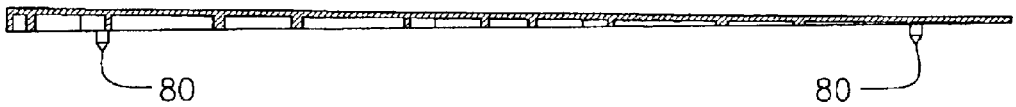
FIG. 24 is a sectional view in elevation of the thin panel of FIG. 22 along line 24—24.
Figure 25:
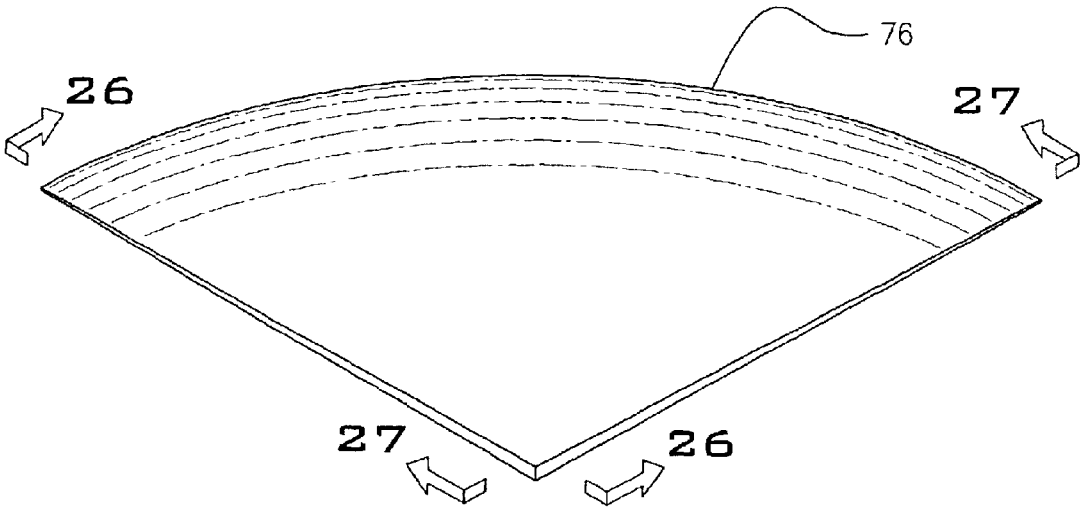
FIG. 25 is a top perspective view of a third auxiliary thin panel to adjust the slant of the putting surface.
Figure 26:
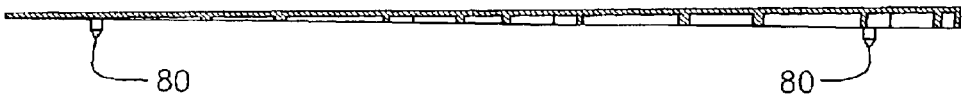
FIG. 26 is a sectional view in elevation of the thin panel of FIG. 25 along line 26—26.
Figure 27:
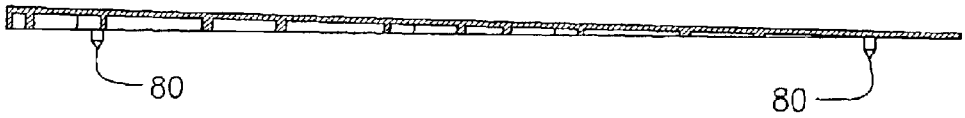
FIG. 27 is a sectional view in elevation of the thin panel of FIG. 25 along line 27—27.
Figure 28:
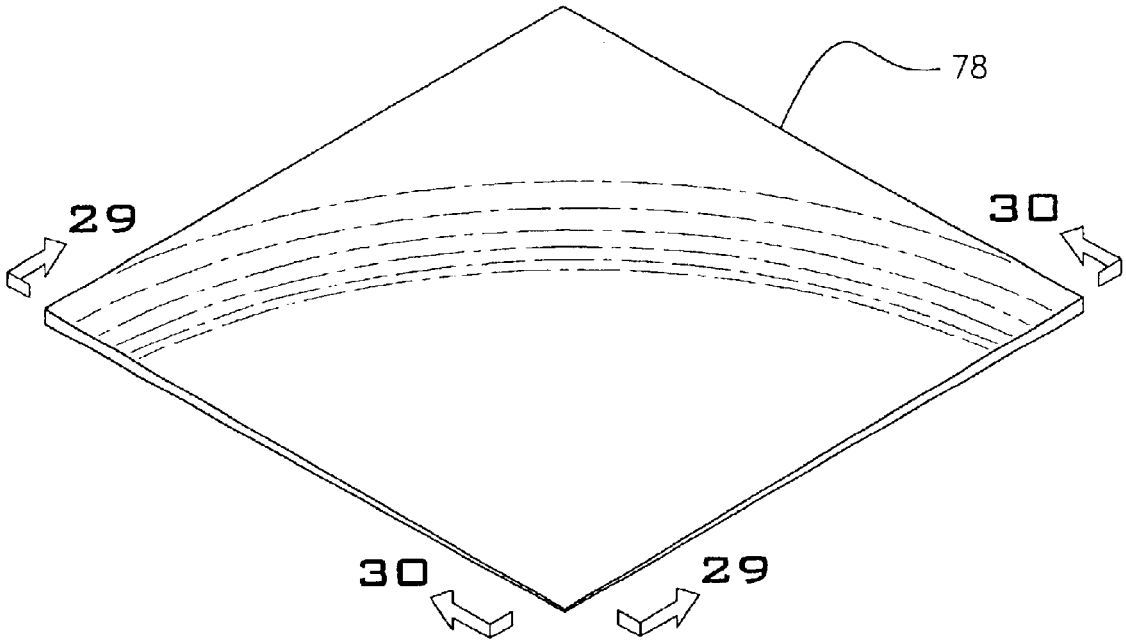
FIG. 28 is a top perspective view of a fourth auxiliary thin panel to adjust the slant of the putting surface.
Figure 29:
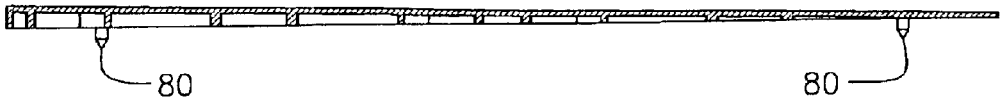
FIG. 29 is a sectional view in elevation of the thin panel of FIG. 28 along line 29—29.
Figure 30:
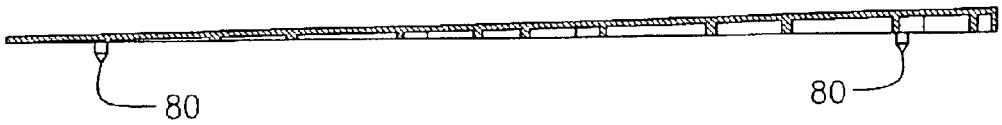
FIG. 30 is a sectional view in elevation of the thin panel of FIG. 28 along line 30—30.
Figure 31:
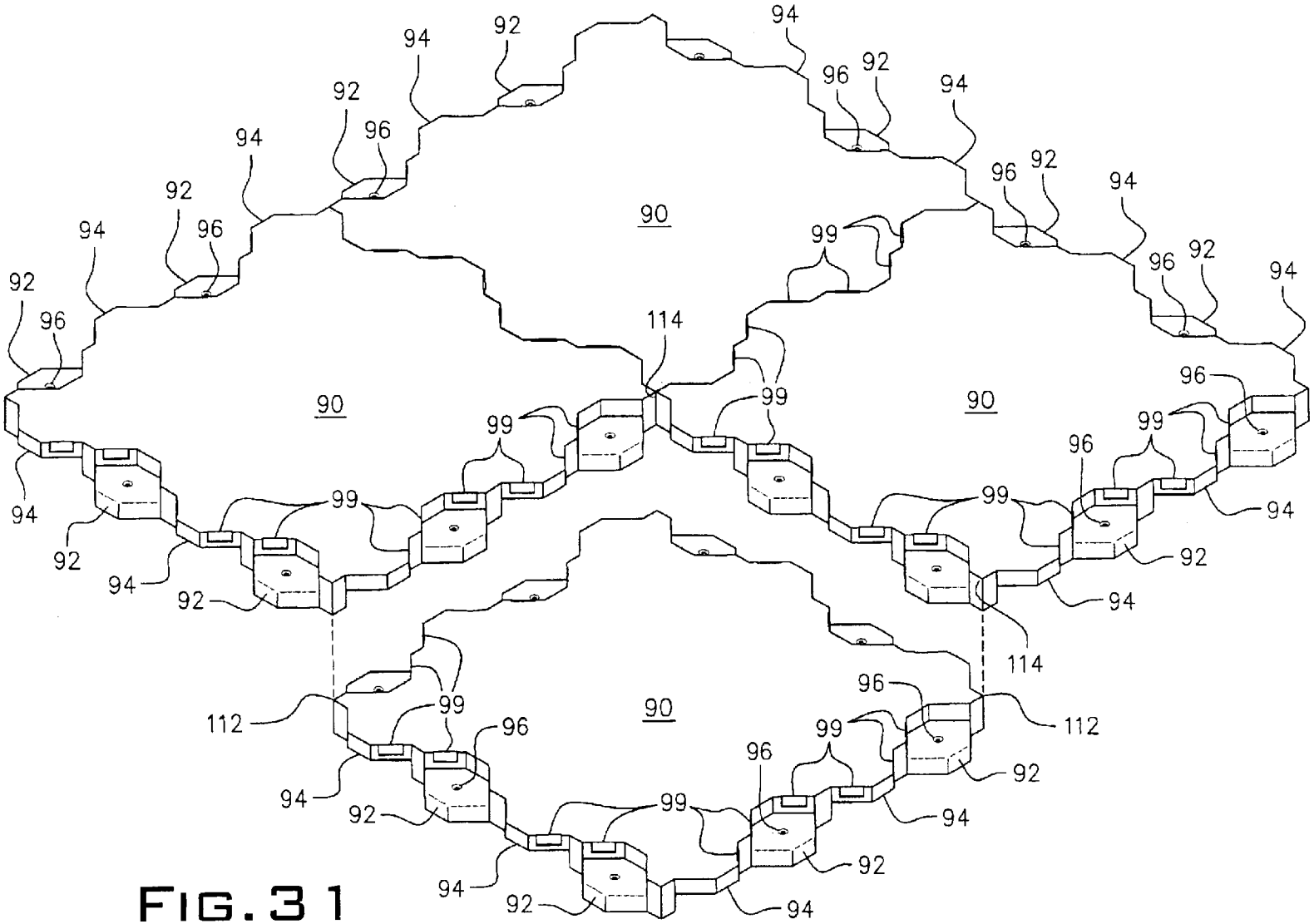
FIG. 31 is a perspective view of alternative panels with their locking mechanism.

A platform panel 70 can be joined to an end of a practice green 10 to provide a stand for putting as seen in FIGS. 16–17.

Each polymeric panel unit 12, 14, 16 18, and 24 is compression molded, blow molded or injection molded with a grid structure 40 on a bottom portion integral with a planar top surface 25. Other types of molding of the polymeric panels that can be used include low pressure flow molding, rotational molding, structural foam injection molding vacuum forming and reaction injection molding. Synthetic turf or carpet made of wool fibers or polymer fibers can be used for the simulated grass surface 38 of the putting training green 10 and is laid point to point at the base of the raised edges 36.

The polymer employed in the molding and creation of the polymeric panels 12, 14, 16, 18 and 24 can be any of the high strength polymers such as polyethylene, polypropylene and copolymers thereof and structural foams such as made from polyurethane. Fiberglass filled reinforcement strands are added to the polymer to increase strength.

The contiguous raised pads 37 are joined together from raised pads 72, 74, 76 or 78 as seen in FIGS. 18–30. These raised pads have bottom pegs 80 which can be inserted into bore 82 in any of the panel surfaces 25 to provide contour instead of the usual planar surface 25 on the panels. These pads 72, 74, 76 or 78 are placed under the simulated grass 38 over the panels to provide an additional putting challenge to the golfer and more realistically simulate an actual putting surface. The pads have a bottom shallow grid surface 84 and downwardly descending pins 80 to engage holes 82 on the panels. Cut outs 86 on the pads can be used to accommodate cups 20. The raised pads are molded in the same manner as the panels and from the same materials.

Figure 32:
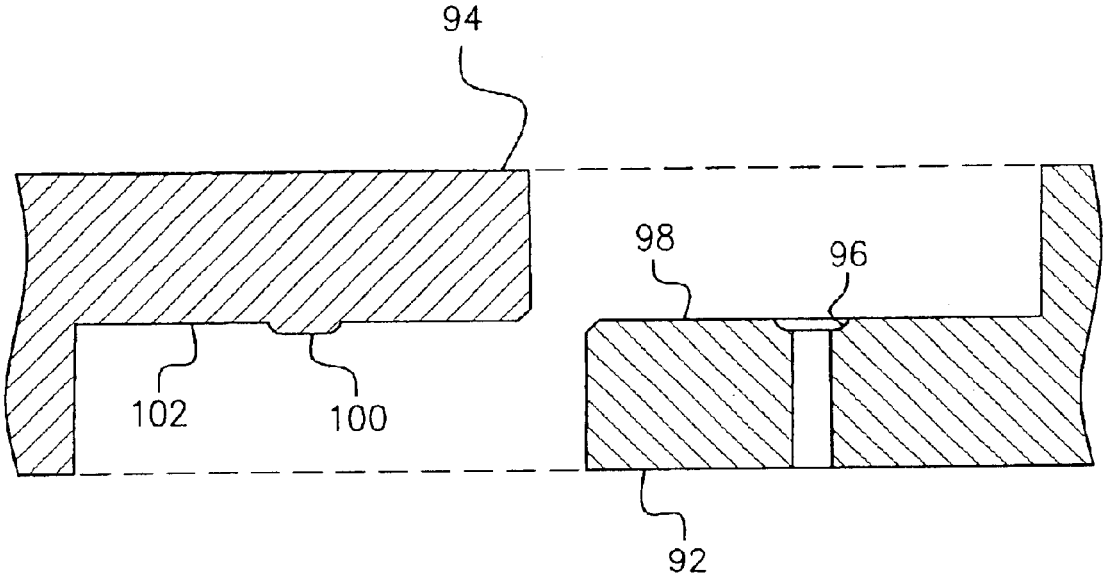
FIG. 32 is a side sectional view in elevation showing adjacent polymeric edge panels of FIG. 3 ready to be locked together.
Figure 33:
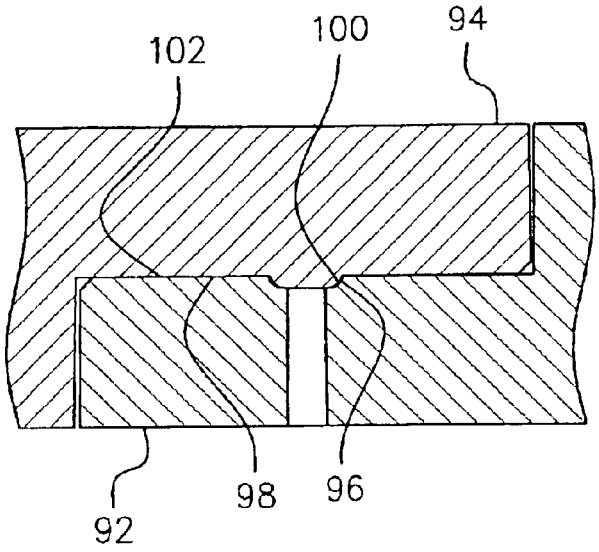
FIG. 33 is a side sectional view in elevation showing the adjacent polymeric edge panels of FIG. 31 locked together.
Figure 34:
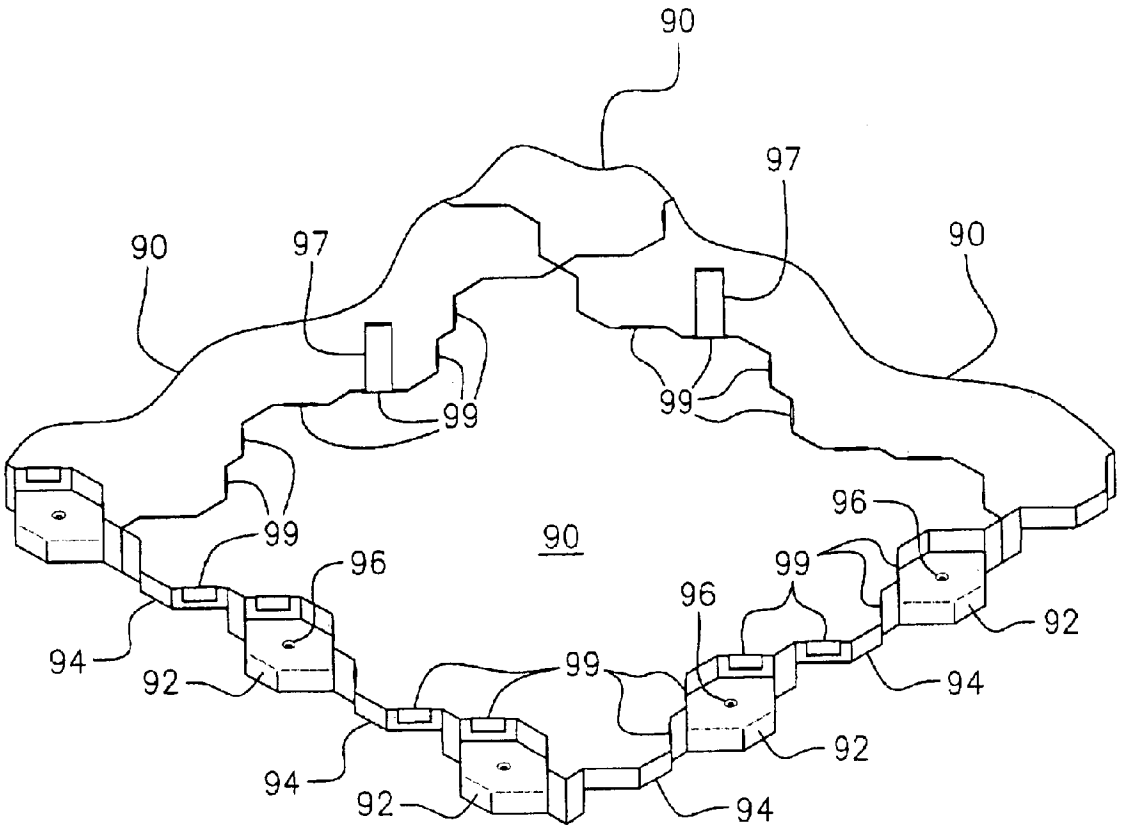
FIG. 34 is a perspective view of the panels of FIG. 31 with pry bars inserted in slots in the side of the panel.

A fourth alternative polymeric edge panel 90 is shown in FIGS. 31–40. Panels 90 have an irregular multiple side surface configuration, each side surface having alternating upright facing side step 92 and downward facing side step 94. Steps 94 contain a downwardly pointing convex projection 100 on lower surface 102. Steps 92 contain a concave dimple 96 on upper surface 98 as shown in FIGS. 32 and 33. The adjacent panels 90 are slid together to engage a convex projection 100 in concave dimple 96. A pry bar 97 is inserted in side slot 99 in order to disengage adjacent panels 90 as shown in FIG. 34.

Figures 35, 35A:
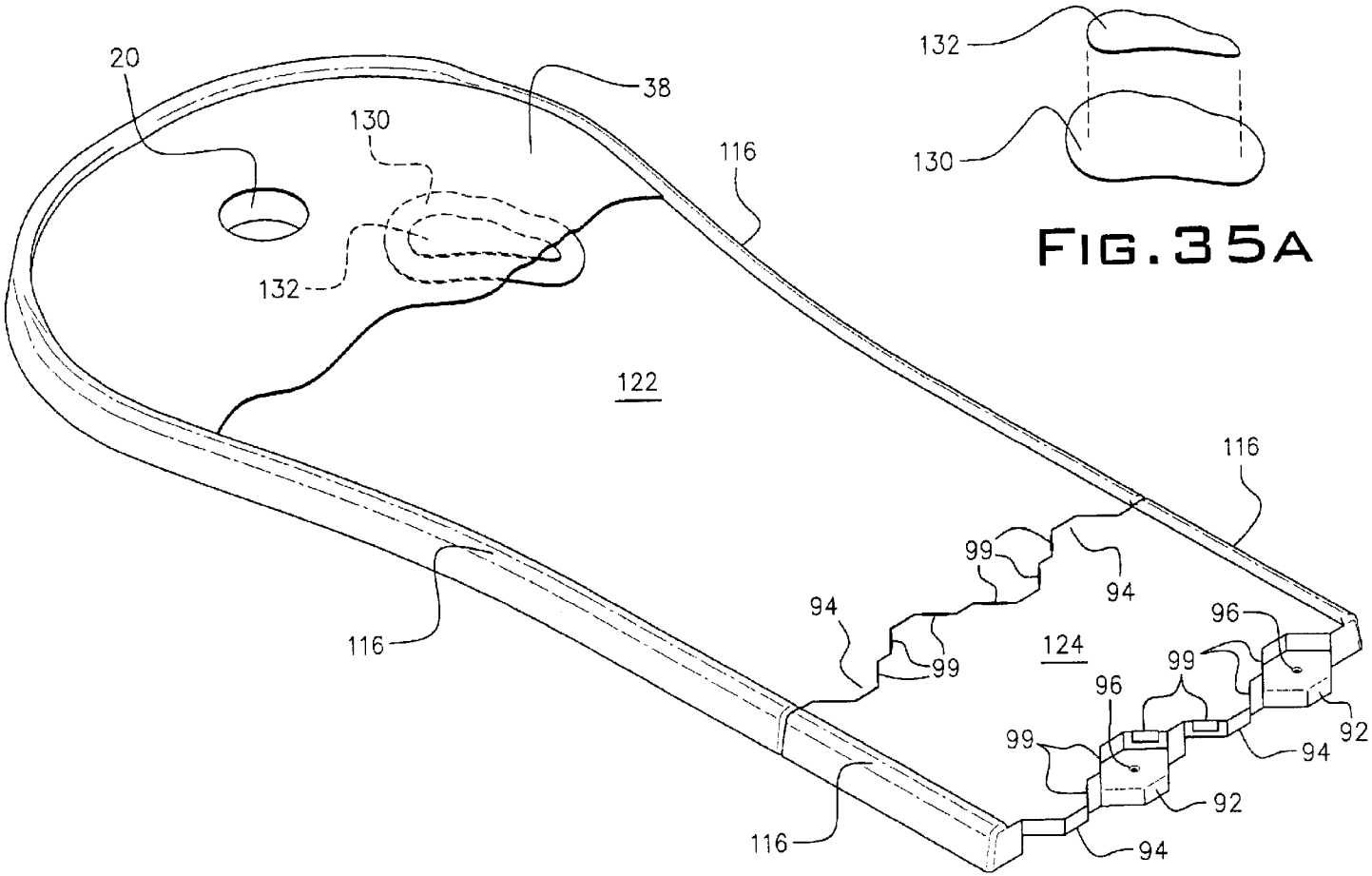
FIG. 35 is a perspective view of a putting green employing a panel with the locking mechanism of FIG. 31.
FIG. 35A is a perspective view of two rubber mats.

The locking mechanism employed as described for panels 90 can be also employed as shown in FIG. 35 to lock a back section 122 of a putting green to lengthening panel sections 124. Bumper rails 116 are attached to the sides of panels 122 and 124. A thin rubber mat 130 about one eighth inch thick can be inserted under the grass layer 38 to provide a contour to the putting green. A higher contour can be achieved by a second rubber mat 132 on top of 130.

Figure 36:
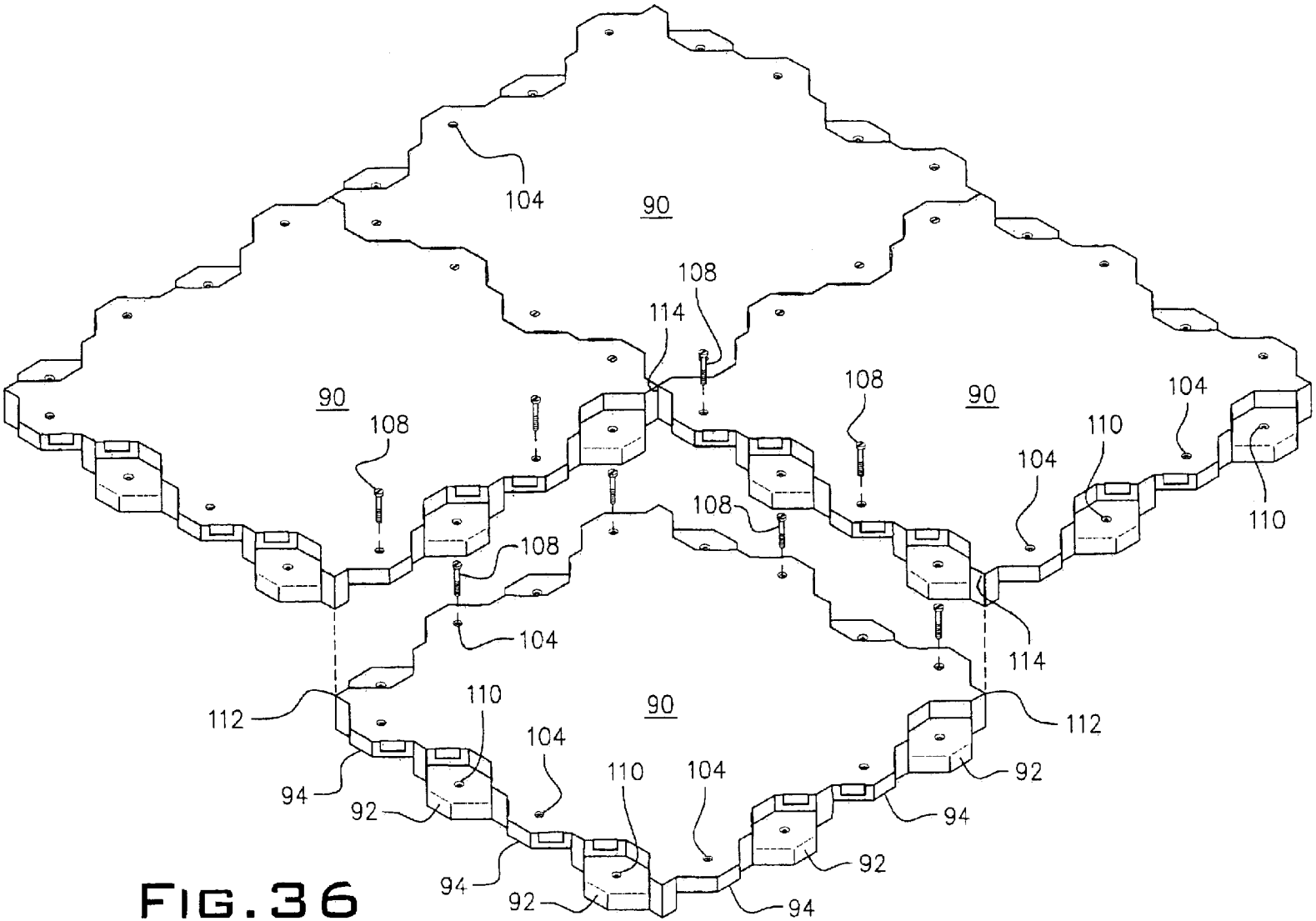
FIG. 36 is a perspective view of the alternative panels according to FIG. 31 with additional bores for screws to facilitate bonding of adjacent panels.
Figure 37:
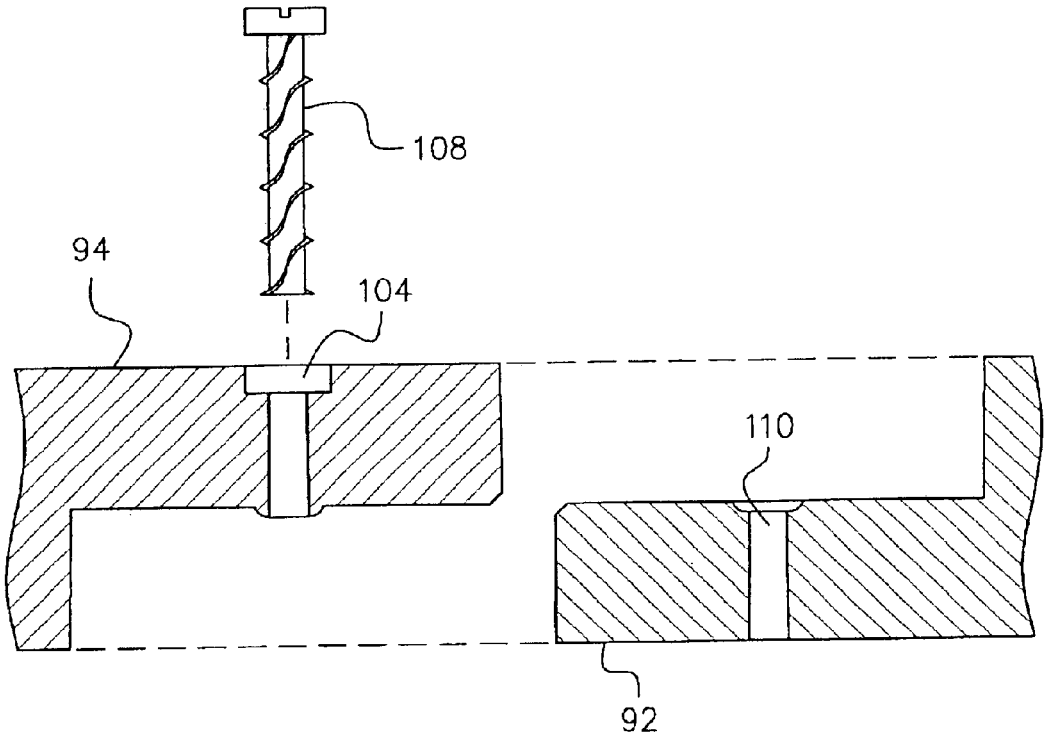
FIG. 37 is a side sectional view in elevation showing the use of screws for locking adjacent panels of FIG. 36 together.
Figure 38:
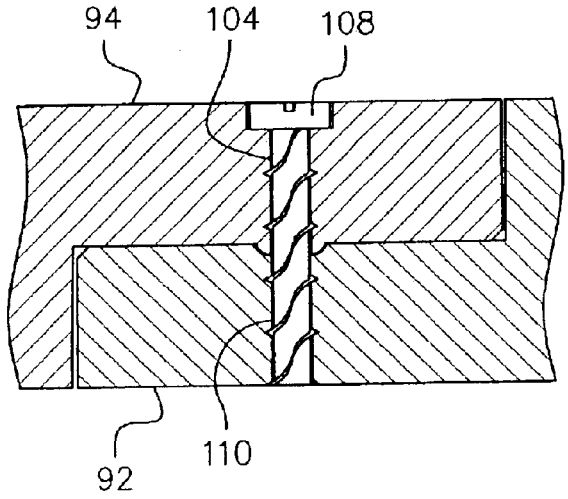
FIG. 38 is a side sectional view in elevation showing two adjacent panels of FIG. 36 locked together and firmly joined with a screw.
Figure 39:
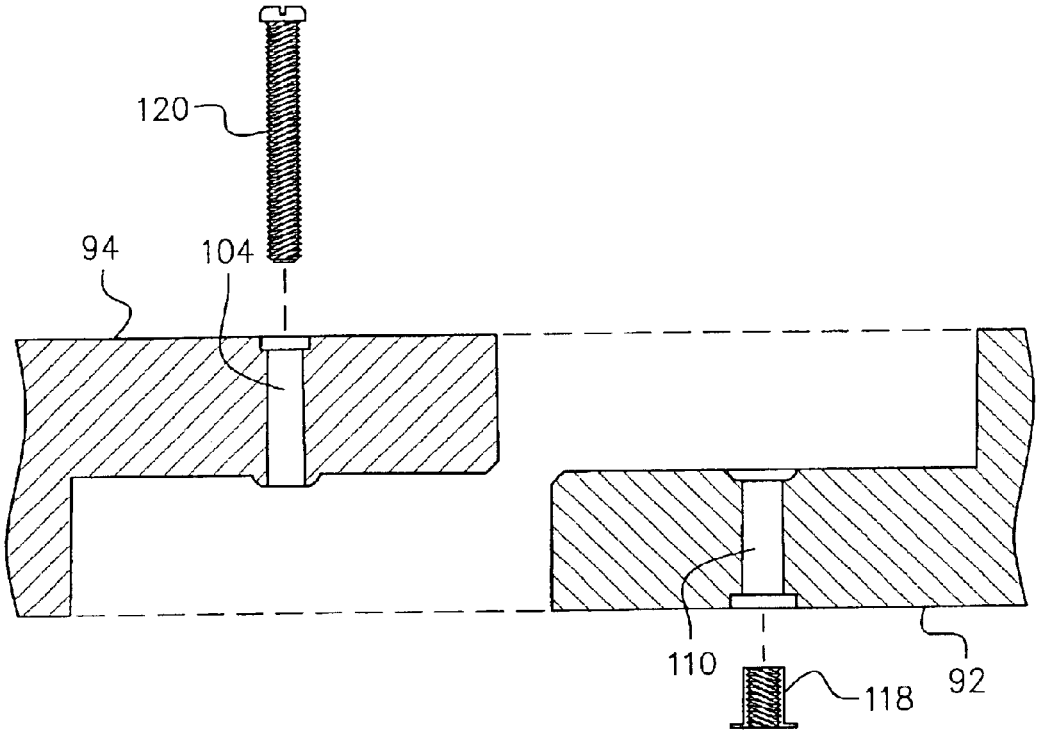
FIG. 39 is a side sectional view in elevation showing the use of a screw and threaded insert for locking adjacent panels of FIG. 36 together.
Figure 40:
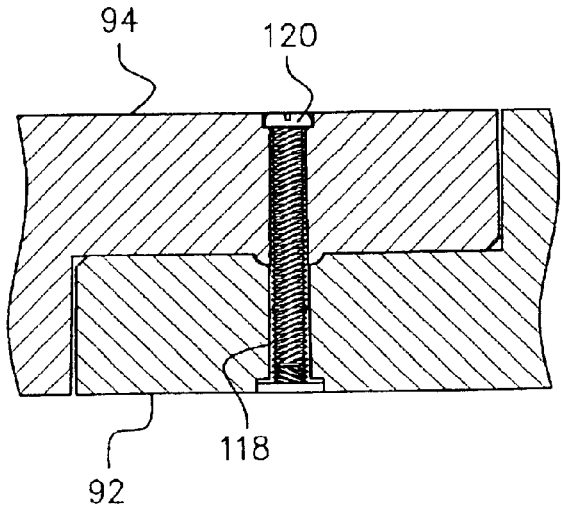
FIG. 40 is a side sectional view in elevation showing two adjacent panels of FIG. 36 locked together and firmly joined with the screw and threaded insert.

An alternative locking mechanism for panels 90 are shown in FIGS. 36–40. Bores 104 are drilled in the top surface of panels 90 above each downwardly facing step 94 and bores 110 are drilled in the top surface of each upwardly facing step 92. A screw 108 as shown in FIGS. 36–38 is threaded through bores 104 and 110 to join panels 90 together. Nipple projection 112 is guided into indentation 114 to join the corners of panels 90 together as shown in FIG. 36. An alternative screw 120 and insert 118 as shown in FIGS. 39 and 40 can be substituted for screw 108 shown in FIGS. 37–38 to join panels 90 together.

The above description has described specific structural details employing the invention. However, it will be within one having skill in the art to make modifications without departing from the spirit and scope of the underlying inventive concept of this portable golf putting and chipping training green. The invention is not limited to the structure described but includes such modifications as are substantially equivalent to the elements of the golf putting training green.

Having thus described the invention, what is claimed and desired to be secured by Letters Patent is:

1. A portable golf putting and chipping practice green comprising:

multiple molded polymeric panels of an irregular multiple side surface configuration, each side surface having alternating upwardly and downwardly facing steps, the steps of adjacent panels engaging each other to form complementary upwardly and downwardly facing pairs of steps, each polymeric panel molded as an integral body having a planar top surface and a grid structure supporting the top surface;

the steps of the side surfaces of one panel mechanically attached to a complementary step of an adjacent panel; and a simulated grass layer covering the planar top surface of the attached multiple molded polymeric panels.

2. The portable golf putting and chipping practice green according to claim 1 wherein the simulated grass is a synthetic turf.

3. The portable golf putting and chipping practice green according to claim 1 wherein the simulated grass is a carpet.

4. The portable golf putting and chipping practice green according to claim 1 wherein the steps of the molded polymeric panels have a complementary projecting convex surface from one step engaging a concave dimple on the step from an adjacent panel to mechanically lock the panels together.

5. The portable golf putting and chipping practice green according to claim 1 wherein the steps are mechanically attached by a screw passing through bores in complementary downwardly and upwardly facing steps from separate adjacent panels.

6. The portable golf putting and chipping practice green according to claim 1 wherein the steps are mechanically attached by a screw passing through a bore in one step and engaging a threaded insert in a complementary step in an adjacent panel.

7. The portable golf putting and chipping practice green according to claim 1 wherein at least one panel has an arcuate cup opening in a top surface to accommodate a golf ball, an interior surface of the cup having an annular flange.

8. The portable golf putting and chipping practice green according to claim 7 wherein the arcuate cup annular flange supports an annular collar inside the cup.

9. The portable golf putting and chipping practice green according to claim 7 wherein the annular flange supports a plug having a top surface contiguous with a top surface of the panel.

10. The portable golf putting and chipping practice green according to claim 1 wherein a raised pad having contour lines is mounted on the top surface of the polymeric panel with the cup and hole axially aligned with a hole in the simulated grass layer mounted over the raised pad.

11. A portable golf putting and chipping practice green comprising:

multiple polymeric panels mechanically joined together, each polymeric panel molded as a rigid integral body having a planar top surface, bottom grid structure and multiple side surfaces;

a side surface of each panel joined together having alternating downwardly and upwardly facing steps, the upwardly facing step of one panel mating with a downwardly facing step of a side surface of an adjacent panel; and a simulated grass layer covering the planar top surface of the joined multiple molded polymeric panels.

12. The portable golf putting and chipping practice green according to claim 11 wherein the mating steps are mechanically joined by complementary convex projections entering a concave dimple on adjacent side surfaces of contiguous panel.

13. The portable golf putting and chipping practice green according to claim 11 wherein a bumper rail encloses the panels on one side surface.

14. A portable golf putting and chipping practice green comprising:

a multiplicity of one piece sectional molded rigid polymeric panels, each panel having alternating downwardly and upwardly facing steps in a side surface, a planar top surface, a grid structure below the top surface and an annular cup projecting downwardly from the top surface of at least one molded polymeric panel, the cup adapted to receive a golf ball;

the panels mechanically joined together along adjacent side surfaces; and a simulated grass layer covering the planar top surface of the joined molded polymeric panels.

15. The portable golf putting and chipping practice green according to claim 14 wherein polymeric panels are molded from fiber filled polypropylene.

16. The portable golf putting and chipping practice green according to claim 14 wherein the polymeric panels are formed by compression molding.

17. The portable golf putting and chipping practice green according to claim 14 wherein raised pads are mounted above portions of the planar top surface of the panels and under the simulated grass.

18. The portable golf putting and chipping practice green according to claim 14 wherein the simulated grass layer is synthetic turf.

19. The portable golf putting and chipping practice green according to claim 14 wherein the panels are mechanically joined together by a step in a side surface of one panel having a convex projection engaging a concave dimple in a step on a side surface of an adjacent panel.

20. The portable golf putting and chipping practice green according to claim 14 wherein the panels are mechanically joined together by a screw passing through complementary steps in adjacent panels.

* * * * *